US008906217B2

(12) United States Patent
Abys et al.

(10) Patent No.: US 8,906,217 B2
(45) **Date of Patent: *Dec. 9, 2014**

(54) COMPOSITE COATINGS FOR WHISKER REDUCTION

(75) Inventors: Joseph A. Abys, Guilford, CT (US); Jingye Li, West Haven, CT (US); Edward J. Kudrak, Jr., Morganville, NJ (US); Chen Xu, New Providence, NJ (US)

(73) Assignee: Enthone Inc., West Haven, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/556,522

(22) Filed: Jul. 24, 2012

(65) Prior Publication Data

US 2012/0285834 A1 Nov. 15, 2012

Related U.S. Application Data

(63) Continuation of application No. 12/254,207, filed on Oct. 20, 2008, now Pat. No. 8,226,807, which is a continuation-in-part of application No. 11/953,936, filed on Dec. 11, 2007, now abandoned.

(51) Int. Cl.

| | |
|---|---|
| ***C25D 15/00*** | (2006.01) |
| ***C25D 3/30*** | (2006.01) |
| ***C25D 15/02*** | (2006.01) |

(52) U.S. Cl.

CPC . *C25D 15/02* (2013.01); *C25D 3/30* (2013.01)
USPC ..... 205/109; 205/302

(58) Field of Classification Search

None
See application file for complete search history.

(56) References Cited

U.S. PATENT DOCUMENTS

| | | | | |
|---|---|---|---|---|
| 3,663,384 | A | 5/1972 | Lescure | |
| 3,956,123 | A | 5/1976 | Rosenberg et al. | |
| 3,966,564 | A | 6/1976 | Hyner et al. | |
| 4,029,556 | A | 6/1977 | Monaco et al. | |
| 4,049,508 | A | 9/1977 | Morrissey | |
| 4,093,466 | A | 6/1978 | Davis | |
| 4,098,654 | A * | 7/1978 | Helle et al. | 205/109 |
| 4,162,205 | A | 7/1979 | Wilson et al. | |
| 4,168,223 | A | 9/1979 | Igarashi et al. | |
| 4,194,913 | A | 3/1980 | Davis | |
| 4,207,148 | A | 6/1980 | Hsu | |
| 4,252,618 | A | 2/1981 | Grenda | |
| 4,263,106 | A | 4/1981 | Kohl | |
| 4,312,772 | A | 1/1982 | Mori | |
| 4,331,518 | A | 5/1982 | Wilson | |
| 4,347,107 | A | 8/1982 | Teichmann et al. | |
| 4,459,185 | A | 7/1984 | Obata et al. | |
| 4,511,413 | A | 4/1985 | Tuttle et al. | |
| 4,657,632 | A | 4/1987 | Holtzman et al. | |
| 4,665,113 | A | 5/1987 | Eberl | |
| 4,728,398 | A * | 3/1988 | Paulet et al. | 205/109 |
| 4,749,626 | A | 6/1988 | Kadija et al. | |
| 4,935,312 | A | 6/1990 | Nakayama et al. | |
| 4,959,278 | A | 9/1990 | Shimauchi et al. | |
| 5,028,492 | A * | 7/1991 | Guenin | 428/614 |
| 5,039,576 | A | 8/1991 | Wilson | |
| 5,066,367 | A * | 11/1991 | Nobel et al. | 205/254 |
| 5,141,702 | A | 8/1992 | Guenin et al. | |
| 5,160,422 | A | 11/1992 | Nishimura et al. | |
| 5,196,053 | A | 3/1993 | Dodd et al. | |
| 5,393,573 | A | 2/1995 | MacKay | |
| 5,435,838 | A | 7/1995 | Melton et al. | |
| 5,554,211 | A | 9/1996 | Bokisa et al. | |
| 5,667,659 | A * | 9/1997 | Souza et al. | 205/109 |
| 5,732,322 | A | 3/1998 | Nakamaru et al. | |
| 5,853,557 | A * | 12/1998 | Souza et al. | 205/109 |
| 5,916,695 | A | 6/1999 | Fister et al. | |
| 6,110,608 | A | 8/2000 | Tanimoto et al. | |
| 6,136,460 | A | 10/2000 | Chen et al. | |
| 6,203,936 | B1 | 3/2001 | Cisar et al. | |
| 6,254,979 | B1 | 7/2001 | Drew et al. | |
| 6,274,254 | B1 | 8/2001 | Abys et al. | |
| 6,305,847 | B1 | 10/2001 | Tanaka et al. | |
| 6,447,167 | B1 * | 9/2002 | Kashiwada et al. | 384/100 |
| 6,465,089 | B2 | 10/2002 | Niwa et al. | |
| 6,635,166 | B2 | 10/2003 | Saji et al. | |
| 6,651,521 | B2 | 11/2003 | Carbone et al. | |
| 6,720,499 | B2 | 4/2004 | Bokisa et al. | |
| 6,799,832 | B1 | 10/2004 | Adavikolanu et al. | |

(Continued)

FOREIGN PATENT DOCUMENTS

| | | | |
|---|---|---|---|
| GB | 1331529 | * | 9/1973 |
| JP | S54-159342 | | 12/1979 |
| JP | 2002348699 | | 12/2002 |
| WO | WO 98/23444 A1 | * | 6/1998 |

OTHER PUBLICATIONS

International Search Report issued in International PCT Application Serial No. PCT/US2008/086203, dated Jan. 29, 2009, 3 pages.

Written Opinion issued in International PCT Application Serial No. PCT/US2008/086203, dated Jan. 29, 2009, 7 pages.

International Preliminary Report on Patentability issued in International PCT Application Serial No. PCT/US2008/086203, dated Jun. 15, 2010, 7 pages.

*Primary Examiner* — Harry D Wilkins, III

(74) *Attorney, Agent, or Firm* — Senniger Powers LLP

(57) ABSTRACT

There is provided a method and composition for applying a wear resistant composite coating onto a metal surface of an electrical component. The method comprises contacting the metal surface with an electrolytic plating composition comprising (a) a source of tin ions and (b) non-metallic particles, and applying an external source of electrons to the electrolytic plating composition to thereby electrolytically deposit the composite coating onto the metal surface, wherein the composite coating comprises tin metal and the non-metallic particles.

18 Claims, 43 Drawing Sheets

(56) References Cited

U.S. PATENT DOCUMENTS

| | | | | |
|---|---|---|---|---|
| 6,815,066 | B2 | 11/2004 | Elliot | |
| 6,818,116 | B2 | 11/2004 | Stoffer et al. | |
| 6,835,449 | B2 | 12/2004 | Kim et al. | |
| 6,878,461 | B2 | 4/2005 | Kobayashi et al. | |
| 6,881,784 | B2 | 4/2005 | Cody et al. | |
| 6,905,782 | B2 | 6/2005 | Laurello et al. | |
| 6,923,692 | B2 | 8/2005 | Niebauer | |
| 7,045,050 | B2 | 5/2006 | Tanaka et al. | |
| 7,195,702 | B2 | 3/2007 | Bokisa, Sr. et al. | |
| 7,638,581 | B2 | 12/2009 | Jing et al. | |
| 8,226,807 | B2 * | 7/2012 | Abys et al. | 205/109 |
| 2002/0026752 | A1 * | 3/2002 | Culler et al. | 205/109 |
| 2002/0157957 | A1 * | 10/2002 | Saji et al. | 205/109 |
| 2003/0025182 | A1 | 2/2003 | Abys et al. | |
| 2006/0225605 | A1 | 10/2006 | Kloeckener et al. | |
| 2007/0037377 | A1 | 2/2007 | Richardson et al. | |

* cited by examiner 500X original

1KX original

3KX original

COMPOSITE COATINGS FOR WHISKER REDUCTION

REFERENCE TO RELATED APPLICATION

This is a continuation of application Ser. No. 12/254,207, filed Oct. 20, 2008, now U.S. Pat. No. 8,226,807, which is a continuation-in-part of application Ser. No. 11/953,936 filed on Dec. 11, 2007, now abandoned, the entire disclosures of which are incorporated by reference.

FIELD OF THE INVENTION

This invention relates to methods of depositing composite coatings comprising tin and non-metallic particles, the composite coatings being characterized by increased wear resistance, corrosion resistance, and enhanced resistance to tin whisker formation.

BACKGROUND OF THE INVENTION

For much of its history, the electronics industry has relied on tin-lead solders to make connections in electronic components. Under environmental, competitive, and marketing pressures, the industry is moving to alternative solders that do not contain lead. Pure tin is a preferred alternative solder because of the simplicity of a single metal system, its favorable physical properties, and its proven history as a reliable component of popular solders previously and currently used in the industry. The growth of tin whiskers is a well known but poorly understood problem with pure tin coatings. Tin whiskers may grow between a few micrometers to a few millimeters in length, which is problematic because whiskers may electrically connect multiple features resulting in electrical shorts. The problem is particularly pronounced in high pitch input/output components with closely configured features, such as lead frames and connectors.

Electrical connectors are important features of electrical components used in various applications, such as computers and other consumer electronics. Connectors provide the path whereby electrical current flows between distinct components. Connectors should be conductive, corrosion resistant, wear resistant, and for certain applications solderable. Copper and its alloys have been used as the connector base material because of their conductivity. Thin coatings of tin have been applied to connector surfaces to assist in corrosion resistance and solderability. Tin whiskers in the tin coating present a problem of shorts between electrical contacts.

Accordingly, a need continues to exist for electrical components with a coating that imparts wear resistance, corrosion resistance, and a reduced propensity for whisker growth.

SUMMARY OF THE INVENTION

Among the various aspects of the present invention may be noted methods and compositions for depositing composite coatings comprising tin and non-metallic particles onto substrates such as electrical components. The deposited composite coatings are characterized by increased corrosion resistance, decreased friction coefficient, and increased resistance to tin whisker growth.

Accordingly, the invention is directed to a method for applying a wear resistant composite coating onto a metal surface of an electrical component. The method comprises contacting the metal surface with an electrolytic plating composition comprising (a) a source of tin ions and (b) non-metallic particles having a surfactant coating and applying an external source of electrons to the electrolytic plating composition to thereby electrolytically deposit the composite coating onto the metal surface, wherein the composite coating comprises tin and the non-metallic particles.

The invention is further directed to an electrolytic plating composition for plating a wear resistant composite coating onto a metal surface of an electrical component. The composition comprises a source of tin ions and non-metallic particles having a surfactant coating.

Other objects and features of the invention will be, in part, noted hereafter, and in part, apparent.

DETAILED DESCRIPTION OF THE EMBODIMENT(S) OF THE INVENTION

In accordance with this invention, a composite coating comprising tin having reduced tendency for whisker formation, increased wear resistance, increased corrosion resistance, and reduced friction coefficient is formed on a metal surface of an electronic component. The method of depositing the composite coating achieves these advantages by incorporating non-metallic particles into the composite coating.

Non-metallic particles incorporated into the composite coating of the present invention in certain preferred embodiments comprise fluoropolymer particles. Unexpectedly, composite coatings comprising tin and non-metallic particles, such as fluoropolymer particles, exhibit substantially reduced tin whisker formation after aging. Without being bound to a particular theory, it is thought that fluoropolymer particles, such as Teflon®, are a soft material in the tin-coating, which serves as a stress buffer to relieve compressive stress in the tin coating and thus reduce the occurrence of tin whiskers. Moreover, fluoropolymer particles, for example, particles comprising Teflon®, function as solid lubricants in the coating of the invention, which is important in reducing the composite coating's friction coefficient. The particles, due to their hydrophobicity, increase the interfacial contact angle of the composite coating/air/water interface. Contact angle is a reliable quantitative measure of hydrophobicity, and thus measures the ability of the composite coating to repel water. The composite coatings of the present invention exhibit high contact angles and are thus hydrophobic. The hydrophobic nature of the composite coatings contributes to their enhanced corrosion resistance.

Figure 1:
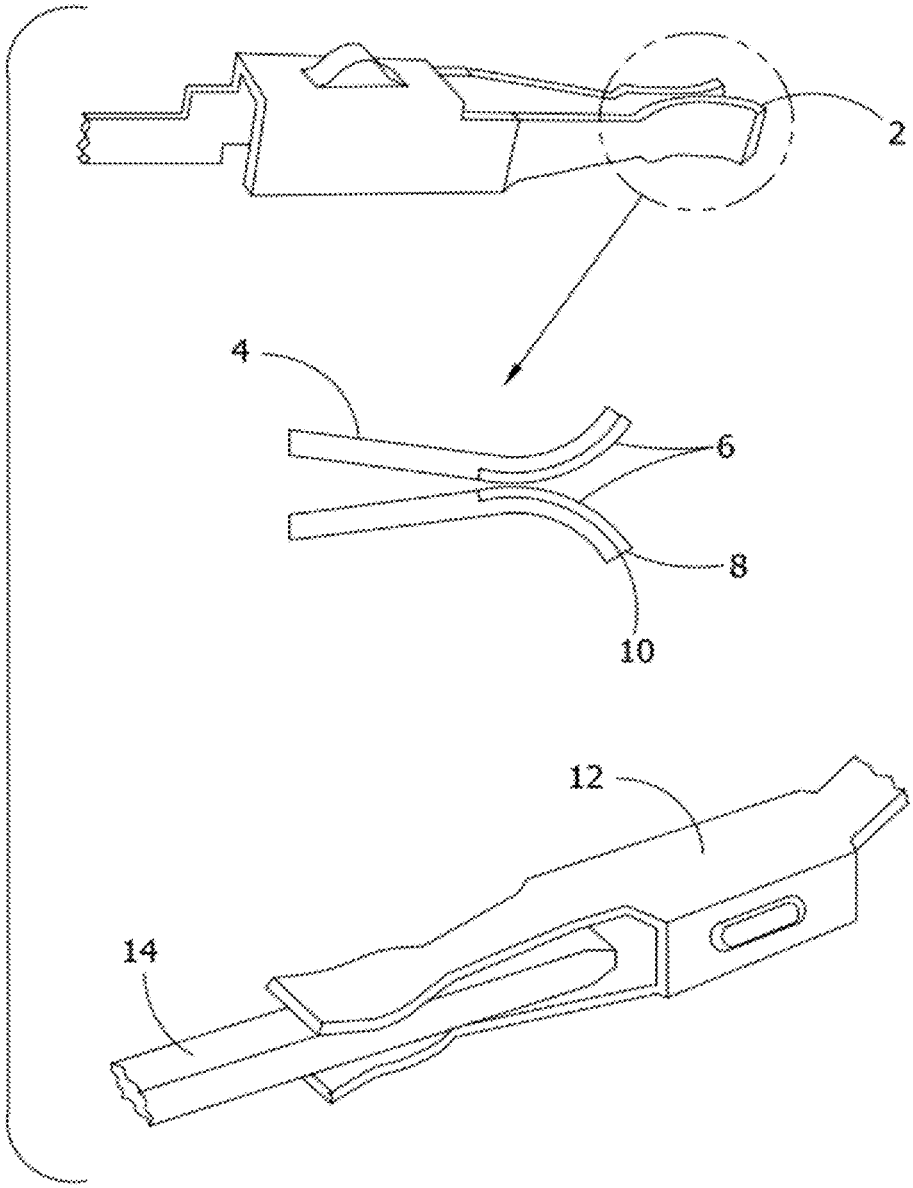
FIG. 1 is a depiction of a circuit pack connector and a depiction of that connector with a mating compliant pin.

An electronic device can be formed by combining several electronic components. For example, one such component is an electronic connector as shown in FIG. 1, in which the inlay tip 2 comprises a copper base 4 having thereon a nickel layer 10, a silver/palladium layer 8, and a gold cap 6. The contact 12 may be mated with a gold flashed palladium pin 14. Generally, the connector's base metal may be copper or a copper alloy such as brass or bronze. Conventionally, tin or tin alloy coatings may be applied to the surface of the base material to enhance the connector's wear resistance. According to the present invention, the method of depositing the tin or tin alloy coating further incorporates a non-metallic particle, thus depositing a composite coating comprising tin and non-metallic particle. Advantageously, the metal feature is characterized by enhanced resistance to tin whisker formation after application of the composite coating of the present invention. Moreover, the composite coating of the present invention is applied to further enhance the wear resistance, corrosion resistance, and reduce the coefficient of friction thereby reducing insertion forces. Reducing insertion forces is important with regard to electrical connectors in order to reduce the mechanical damage and overall wear which may result from being inserted and re-inserted into a socket.

It has been discovered that composite coatings comprising, in one embodiment, tin and non-metallic particles, for example, nano-particulate fluoropolymers, may be deposited in a manner that yields smooth, bright, and glossy coatings. Moreover, the composite coatings are resistant to tin whisker formation, as well as being characterized by increased wear resistance and corrosion resistance. In another embodiment, the composite coatings may comprises larger sized particles, wherein said composite coatings are characterized by a matte appearance, due to the light scattering effect of the large particles. Yet, in some embodiments, the composite coatings comprise larger sized particles since such particles may be useful in reducing the propensity for whiskers even though they may have undesired appearance characteristics. Composite coatings comprising tin and nano-particles, on the other hand, are particularly suitable for applications requiring a glossy surface/interface, while also providing the advantages of wear resistance, tin whisker resistance, and so on. The composite coating may additionally comprise another metal co-deposited with the tin and non-metallic particle. Exemplary metals include bismuth, copper, zinc, silver, lead, and combinations thereof.

Particular fluoropolymers suitable for the plating compositions of the present invention comprise polytetrafluoroethylene (PTFE, marketed, for example, under the trade name Teflon®), fluorinated ethylene-propylene copolymer (FEP), perfluoroalkoxy resin (PFE, a copolymer of tetrafluoroethylene and perfluorovinylethers), ethylene-tetrafluoroethylene copolymer (ETFE), polychlorotrifluoroethylene (PCTFE), ethylene-chloro-trifluoroethylene copolymer (ECTFE), polyvinylidene fluoride (PVDF), and polyvinyl fluoride (PVF), with polytetrafluoroethylene currently preferred. Preferably the fluoropolymer particles are PTFE particles.

In one embodiment, the fluoropolymer particles added to the plating compositions of the present invention are nanoparticles. That is, the particles have a mean particle size substantially smaller than the wavelength of visible light, i.e., less than 380 (0.38 μm) to 700 nm (0.7 μm). In one embodiment, the mean particle size of the fluoropolymer particles is preferably substantially smaller than the wavelength of visible light. Accordingly, the mean particle size is less than about 1000 nm, preferably between about 10 nm and about 500 nm, more preferably between about 10 nm and about 200 nm, and in one embodiment between 40 nm and about 120 nm. Exemplary fluoropolymer particles may have mean particle sizes from about 50 nm to about 110 nm or from about 50 nm to about 100 nm, such as between about 90 nm and about 110 nm, or between about 50 nm and about 80 nm.

The mean particle sizes stated above refer to the arithmetic mean of the diameter of particles within a population of fluoropolymer particles. A population of particles contains a wide variation of diameters. Therefore, the particles sizes may be additionally described in terms of a particle size distribution, i.e., a minimum volume percentage of particles having a diameter below a certain limit. In one embodiment, therefore, at least about 50 volume % of the particles have a particle size less than 200 nm, preferably at least about 70 volume % of the particles have a particle size less than 200 nm, more preferably at least about 80 volume % of the particles have a particle size less than 200 nm, and even more preferably at least about 90 volume % of the particles have a particle size less than 200 nm.

In one embodiment, at least about 30 volume % of the particles have a particle size less than 100 nm, preferably at least about 40 volume % of the particles have a particle size less than 100 nm, more preferably at least about 50 volume % of the particles have a particle size less than 100 nm, and even more preferably at least about 60 volume % of the particles have a particle size less than 100 nm.

In another embodiment, at least about 25 volume % of the particles have a particle size less than 90 nm, preferably at least about 35 volume % of the particles have a particle size less than 90 nm, more preferably at least about 45 volume % of the particles have a particle size less than 90 nm, and even more preferably at least about 55 volume % of the particles have a particle size less than 90 nm.

In another embodiment, at least about 20 volume % of the particles have a particle size less than 80 nm, preferably at least about 30 volume % of the particles have a particle size less than 80 nm, more preferably at least about 40 volume % of the particles have a particle size less than 80 nm, and even more preferably at least about 50 volume % of the particles have a particle size less than 80 nm.

In a further embodiment, at least about 10 volume % of the particles have a particle size less than 70 nm, preferably at least about 20 volume % of the particles have a particle size less than 70 nm, more preferably at least about 30 volume % of the particles have a particle size less than 70 nm, and even more preferably at least about 35 volume % of the particles have a particle size less than 70 nm.

The fluoropolymer particles employed in the present invention have a so-called "specific surface area" which refers to the total surface area of one gram of particles. As particle size decreases, the specific surface area of a given mass of particles increases. Accordingly, smaller particles as a general proposition provide higher specific surface areas, and the relative activity of a particle to achieve a particular function is in part a function of the particle's surface area in the same manner that a sponge with an abundance of exposed surface area has enhanced absorbance in comparison to an object with a smooth exterior. The present invention employs particles with surface area characteristics to facilitate achieving particular whisker-inhibition function as balanced against various other factors. In particular, these particles have surface area characteristics which permit the use of a lower concentration of nano-particles in solution in certain embodiments, which promotes solution stability, and even particle distribution and uniform particle size in the deposit. Although it is contemplated that greater PTFE concentration might be addressed by plating process modifications, the particular surface characteristics of this preferred embodiment require addressing stability and uniformity issues to a substantially lesser degree. Moreover, it preliminarily appears possible that higher concentrations of PTFE may have deleterious effects on hardness or ductility; and if this turns out to be true, then the preferred surface area characteristics help avoid this.

In one embodiment, the invention employs fluoropolymer particles where at least about 50 wt %, preferably at least about 90 wt %, of the particles have a specific surface area of at least about 15 $m^2/g$ (e.g., between 15 and 35 $m^2/g$. The specific surface area of the fluoropolymer particles may be as high as about 50 $m^2/g$, such as from about 15 $m^2/g$ to about 35 $m^2/g$. The particles employed in this preferred embodiment of the invention, in another aspect, have a relatively high surface-area-to-volume ratio. These nano-sized particles have a relatively high percent of surface atoms per number of atoms in a particle. For example, a smaller particle having only 13 atoms has about 92% of its atoms on the surface. In contrast, a larger particle having 1415 total atoms has only 35% of its atoms on the surface. A high percentage of atoms on the surface of the particle relates to high particle surface energy, and greatly impacts properties and reactivity. Nanoparticles having relatively high specific surface area and high surface-area-to-volume ratios are advantageous since a relatively smaller proportion of fluoropolymer particles may be incorporated into the composite coating compared to larger particles, which require more particles to achieve the same surface area, and still achieve the effects of increased tin whisker resistance, wear resistance (increased lubricity and decreased coefficient of friction), corrosion resistance and so on. On the other hand, the higher surface activity prevents certain substantial challenges, such as uniform dispersion. Accordingly, as little as 10 wt. % fluoropolymer particle in the composite coating achieves the desired effects, and in some embodiments, the fluoropolymer particle component is as little as 5 wt. %, such as between about 1 wt. % and about 5 wt %. A relatively purer tin coating may be harder and more ductile than a tin coating comprising substantially more fluoropolymer particle; however, the desired characteristics are not compromised by incorporating relatively small amounts of nanoparticles in the composite coating.

Fluoropolymer particles are commercially available in a form which is typically dispersed in a solvent. An exemplary source of dispersed fluoropolymer particles includes Teflon® PTFE 30 (available from DuPont), which is a dispersion of PTFE particles on the order of the wavelength of visible light or smaller. That is, PTFE 30 comprises a dispersion of PTFE particles in water at a concentration of about 60 wt. % (60 grams of particles per 100 grams of solution) in which the particles have a particle size distribution between about 50 and about 500 nm, and a mean particle size of about 220 nm. Another exemplary source of dispersed fluoropolymer particles include Teflon® TE-5070AN (available from DuPont), which is a dispersion of PTFE particles in water at a concentration of about 60 wt. % in which the particles have a mean particle size of about 80 nm. These particles are typically dispersed in a water/alcohol solvent system. Generally, the alcohol is a water soluble alcohol, having from 1 to about 4 carbon atoms, such as methanol, ethanol, n-propanol, isopropanol, n-butanol, iso-butanol, and tert-butanol. Typically, the ratio of water to alcohol (mole:mole) is between about 10 moles of water and about 20 moles of water per one mole of alcohol, more typically between about 14 moles of water and about 18 moles of water per one mole of alcohol.

Alternatively, a solution from a source of dry PTFE particles may be prepared and then added to the electrolytic plating bath. An exemplary source of dry PTFE particles is Teflon® TE-5069AN, which comprises dry PTFE particles having a mean particle size of about 80 nm. Other sources of PTFE particles include those sold under trade name Solvay Solexis available from Solvay Solexis of Italy, and under the trade name Dyneon available from 3M of St. Paul, Minn. (U.S.).

Preferably, the fluoropolymer particles are added to the electrolytic deposition composition with a pre-mix coating, i.e., as a coated particle, in which the coating is a surfactant coating applied prior to combining the particles with the other components (i.e., tin ions, acid, water, anti-oxidants, etc.) of the electrolytic deposition composition. The fluoropolymer particles may be coated with surfactant in an aqueous dispersion by ultrasonic agitation and/or high pressure streams. The dispersion comprising fluoropolymer particles having a surfactant coating thereon may be then added to the electrolytic tin plating composition. The surfactant coating inhibits agglomeration of the particles and enhances the solubility/dispersability of the fluoropolymer particles in solution.

The surfactant may be cationic, anionic, non-ionic, or zwitterionic. A particular surfactant may be used alone or in combination with other surfactants. One class of surfactants comprises a hydrophilic head group and a hydrophobic tail. Hydrophilic head groups associated with anionic surfactants include carboxylate, sulfonate, sulfate, phosphate, and phosphonate. Hydrophilic head groups associated with cationic surfactants include quaternary amine, sulfonium, and phosphonium. Quaternary amines include quaternary ammonium, pyridinium, bipyridinium, and imidazolium. Hydrophilic head groups associated with non-ionic surfactants include alcohol and amide. Hydrophilic head groups associated with zwitterionic surfactants include betaine. The hydrophobic tail typically comprises a hydrocarbon chain. The hydrocarbon chain typically comprises between about six and about 24 carbon atoms, more typically between about eight to about 16 carbon atoms.

Exemplary anionic surfactants include alkyl phosphonates, alkyl ether phosphates, alkyl sulfates, alkyl ether sulfates, alkyl sulfonates, alkyl ether sulfonates, carboxylic acid ethers, carboxylic acid esters, alkyl aryl sulfonates, and sulfosuccinates. Anionic surfactants include any sulfate ester, such as those sold under the trade name ULTRAFAX, including, sodium lauryl sulfate, sodium laureth sulfate (2 EO), sodium laureth, sodium laureth sulfate (3 EO), ammonium lauryl sulfate, ammonium laureth sulfate, TEA-lauryl sulfate, TEA-laureth sulfate, MEA-lauryl sulfate, MEA-laureth sulfate, potassium lauryl sulfate, potassium laureth sulfate, sodium decyl sulfate, sodium octyl/decyl sulfate, sodium 2-ethylhexyl sulfate, sodium octyl sulfate, sodium nonoxynol-4 sulfate, sodium nonoxynol-6 sulfate, sodium cumene sulfate, and ammonium nonoxynol-6 sulfate; sulfonate esters such as sodium α-olefin sulfonate, ammonium xylene sulfonate, sodium xylene sulfonate, sodium toluene sulfonate, dodecyl benzene sulfonate, and lignosulfonates; sulfosuccinate surfactants such as disodium lauryl sulfosuccinate, disodium laureth sulfosuccinate; and others including sodium cocoyl isethionate, lauryl phosphate, perfluorinated alkyl phosphonic/phosphinic acids (such as Fluowet PL 80 available from Clariant), any of the ULTRAPHOS series of phosphate esters, Cyastat® 609 (N,N-Bis(2-hydroxyethyl)-N-(3'-Dodecyloxy-2'-Hydroxypropyl) Methyl Ammonium Methosulfate) and Cyastat® LS ((3-Lauramidopropyl) trimethylammonium methylsulfate), available from Cytec Industries.

Exemplary cationic surfactants include quaternary ammonium salts such as dodecyl trimethyl ammonium chloride, cetyl trimethyl ammonium salts of bromide and chloride, hexadecyl trimethyl ammonium salts of bromide and chloride, alkyl dimethyl benzyl ammonium salts of chloride and bromide, such as coco dimethyl benzyl ammonium salts of chloride, and the like. In this regard, surfactants such as Lodyne® S-106A (Fluoroalkyl Ammonium Chloride Cationic Surfactant 28-30%, available from Ciba Specialty Chemicals Corporation), Ammonyx® 4002 (Octadecyl dimethyl benzyl ammonium chloride Cationic Surfactant, available from Stepan Company, Northfield, Ill.), and Dodigen 226 (coco dimethyl benzyl ammonium chloride, available from Clariant Corporation) are particularly preferred.

A class of non-ionic surfactants includes those comprising polyether groups, based on, for example, ethylene oxide (EO) repeat units and/or propylene oxide (PO) repeat units. These surfactants are typically non-ionic. Surfactants having a polyether chain may comprise between about 1 and about 36 EO repeat units, between about 1 and about 36 PO repeat units, or a combination of between about 1 and about 36 EO repeat units and PO repeat units. More typically, the polyether chain comprises between about 2 and about 24 EO repeat units, between about 2 and about 24 PO repeat units, or a combination of between about 2 and about 24 EO repeat units and PO repeat units. Even more typically, the polyether chain comprises between about 6 and about 15 EO repeat units, between about 6 and about 15 PO repeat units, or a combination of between about 6 and about 15 EO repeat units and PO repeat units. These surfactants may comprise blocks of EO repeat units and PO repeat units, for example, a block of EO repeat units encompassed by two blocks of PO repeat units or a block of PO repeat units encompassed by two blocks of EO repeat units. Another class of polyether surfactants comprises alternating PO and EO repeat units. Within these classes of surfactants are the polyethylene glycols, polypropylene glycols, and the polypropylene glycol/polyethylene glycols.

Yet another class of non-ionic surfactants comprises EO, PO, or EO/PO repeat units built upon an alcohol or phenol base group, such as glycerol ethers, butanol ethers, pentanol ethers, hexanol ethers, heptanol ethers, octanol ethers, nonanol ethers, decanol ethers, dodecanol ethers, tetradecanol ethers, phenol ethers, alkyl substituted phenol ethers, α-naphthol ethers, and β-naphthol ethers. With regard to the alkyl substituted phenol ethers, the phenol group is substituted with a hydrocarbon chain having between about 1 and about 10 carbon atoms, such as about 8 (octylphenol) or about 9 carbon atoms (nonylphenol). The polyether chain may comprise between about 1 and about 24 EO repeat units, between about 1 and about 24 PO repeat units, or a combination of between about 1 and about 24 EO and PO repeat units. More typically, the polyether chain comprises between about 8 and about 16 EO repeat units, between about 8 and about 16 PO repeat units, or a combination of between about 8 and about 16 EO and PO repeat units. Even more typically, the polyether chain comprises about 9, about 10, about 11, or about 12 EO repeat units; about 9, about 10, about 11, or about 12 PO repeat units; or a combination of about 9, about 10, about 11, or about 12 EO repeat units and PO repeat units.

An exemplary β-naphthol derivative non-ionic surfactant is Lugalvan BNO12 which is a β-naphtholethoxylate having 12 ethylene oxide monomer units bonded to the naphthol hydroxyl group. Similar surfactants include Polymax NPA-15, a polyethoxylated nonlyphenol, and Lutensol AP 14, a polyethoxylated p-isononylphenols. Another surfactant is Triton®-X100 nonionic surfactant, which is an octylphenol ethoxylate, typically having around 9 or 10 EO repeat units. Additional commercially available non-ionic surfactants include the Pluronic® series of surfactants, available from BASF. Pluronic® surfactants include the P series of EO/PO block copolymers, including P65, P84, P85, P103, P104, P105, and P123, available from BASF; the F series of EO/PO block copolymers, including F108, F127, F38, F68, F77, F87, F88, F98, available from BASF; and the L series of EO/PO block copolymers, including L10, L101, L121, L31, L35, L44, L61, L62, L64, L81, and L92, available from BASF.

Additional commercially available non-ionic surfactants include water soluble, ethoxylated nonionic fluorosurfactants available from DuPont and sold under the trade name Zonyl®, including Zonyl® FSN (Telomar B Monoether with Polyethylene Glycol nonionic surfactant), Zonyl® FSN-100, Zonyl® FS-300, Zonyl® FS-500, Zonyl® FS-510, Zonyl® FS-610, Zonyl® FSP, and Zonyl® UR. Zonyl® FSN (Telomar B Monoether with Polyethylene Glycol nonionic surfactant) is particularly preferred. Other non-ionic surfactants include the amine condensates, such as cocoamide DEA and cocoamide MEA, sold under the trade name ULTRAFAX. Other classes of nonionic surfactants include acid ethoxylated fatty acids (polyethoxy-esters) comprising a fatty acid esterified with a polyether group typically comprising between about 1 and about 36 EO repeat units. Glycerol esters comprise one, two, or three fatty acid groups on a glycerol base.

In one preferred embodiment, non-metallic particles are in a pre-mix dispersion with a non-ionic coating on the particles prior to mixing in with the other bath components. Then the dispersion is mixed with the other ingredients, including the acid, Sn ions, and a cationic surfactant. A further surfactant coating is deposited over the non-metallic particle in a manner that imparts an overall coating charge, in this instance positive, on the fluoropolymer particles. Preferably, the surfactant coating comprises predominantly of positively charged surfactant molecules. A positively charged surfactant coating will tend to drive the particles, during electrolytic deposition, toward the cathode substrate enhancing co-deposition with tin and optionally the alloying metal. The overall charge of the surfactant coating may be quantified. The charge of a particular surfactant molecule is typically −1 (anionic), 0 (non-ionic or zwitterionic), or +1 (cationic). A population of surfactant molecules therefore has an average charge per surfactant molecule that ranges between −1 (entire population comprises anionic surfactant molecules) and +1 (entire population comprise cationic surfactant molecules). A population of surfactant molecules having an overall 0 charge may comprise 50% anionic surfactant molecules and 50% cationic surfactant molecules, for example; or, the population having an overall 0 charge may comprise 100% zwitterionic surfactant molecules or 100% non-ionic surfactant molecules.

In one embodiment, the surfactant coating comprises a cationic surfactant used alone or in combination with one or more additional cationic surfactants, such that the average charge per surfactant molecule is substantially equal to +1, i.e., the surfactant coating consists substantially entirely of cationic surfactant molecules.

It is not necessary, however, for the surfactant coating to consist entirely of cationic surfactants. In other words, the surfactant coating may comprise combinations of cationic surfactant molecules with anionic surfactant molecules, zwitterionic surfactant molecules, and non-ionic surfactant molecules. Preferably, the average charge per surfactant molecule of the population of surfactant molecules coating the non-metallic particles is greater than 0, and in a particularly preferred embodiment, the surfactant coating comprises a cationic surfactant used alone or in combination with one or more additional cationic surfactants and with one or more non-ionic surfactants. The surfactant coating comprising a population of cationic surfactant molecules and non-ionic surfactant molecules preferably has an average charge per surfactant molecule between about 0.01 (99% non-ionic surfactant molecules and 1% cationic surfactant molecules) and 1 (100% cationic surfactant molecules), preferably between about 0.1 (90% non-ionic surfactant molecules and 10% cationic surfactant molecules) and 1. The average charge per surfactant molecule of the population of surfactant molecules making up the surfactant coating over the non-metallic particles may be at least about 0.2 (80% non-ionic surfactant molecules and 20% cationic surfactant molecules), such as at least about 0.3 (70% non-ionic surfactant molecules and 30% cationic surfactant molecules), at least about 0.4 (60% non-ionic surfactant molecules and 40% cationic surfactant molecules), at least about 0.5 (50% non-ionic surfactant molecules and 50% cationic surfactant molecules), at least about 0.6 (40% non-ionic surfactant molecules and 60% cationic surfactant molecules), at least about 0.7 (30% non-ionic surfactant molecules and 70% cationic surfactant molecules), at least about 0.8 (20% non-ionic surfactant molecules and 80% cationic surfactant molecules), or even at least about 0.9 (10% non-ionic surfactant molecules and 90% cationic surfactant molecules). In each of these embodiments, the average charge per surfactant molecule is no greater than 1.

The concentration of surfactant is determined by the total particle-matrix interface area. For a given weight concentration of the particle, the smaller the mean particle size, the higher the total area of the particle surface. The total surface area is calculated by the specific particle surface ($m^2/g$) multiplied by the particle weight in the solution (g). The calculation yields a total surface area in $m^2$. A given concentration of nanoparticles, having a high specific particle surface area, includes a much greater total number of particles compared to micrometer-sized particles of the same weight concentration. As a result, the average interparticle distance decreases. The interaction between the particles, like the van der waals attraction, becomes more prominent. Therefore, high concentrations of surfactants are used to decrease the particles' tendency to flocculate or coagulate with each other. The surfactant concentration is therefore a function of the mass and specific surface area of the particles. Preferably, therefore, the composition comprises about one gram of surfactant for every about 100 $m^2$ to 200 $m^2$ of surface area of fluoropolymer particles, more preferably about one gram of surfactant for every 120 $m^2$ to about 150 $m^2$ of surface area of fluoropolymer particles.

For example, a dispersion of Teflon® TE-5070AN (total mass 750 grams) has about 450 grams of PTFE particles, having a specific surface area of about 23.0 $m^2/g$ and a total surface area of about 10350 $m^2$. The mass of surfactant for coating and dispersing this total surface area is preferably between 50 grams and about 110 grams, more preferably between about 65 grams and about 90 grams. For example, a composition for dispersing about 450 grams of these PTFE particles may include between about 5 grams and about 25 grams Ammonyx® 4002 (Octadecyl dimethyl benzyl ammonium chloride Cationic Surfactant), between about 5 grams and about 25 grams Zonyl® FSN (Telomar B Monoether with Polyethylene Glycol nonionic surfactant), between about 40 grams and about 60 grams Lodyne® S-106A (Fluoroalkyl Ammonium Chloride Cationic Surfactant 28-300), between about 30 grams and about 50 grams isopropyl alcohol, and between about 150 grams and about 250 grams $H_2O$. The surfactant coating comprises a combination of cationic surfactant and nonionic surfactant to stabilize the fluoropolymer particles in solution. So, for example, the dispersion can be formed with the following components: PTFE particles (450 grams), Ammonyx® 4002 (10.72 g), Zonyl® FSN (14.37 g), Lodyne® S-106A (50.37 g), isopropyl alcohol (38.25 g), and water (186.29 g).

In one embodiment, the composite coating comprising tin and non-metallic particles, such as nano-particulate fluoropolymer, is deposited by an electrolytic plating method. In the electrolytic plating compositions of the present invention, the non-metallic particles preferably having a pre-mix coating comprising surfactant thereon are initially added in a concentration sufficient to impart a non-metallic particle concentration between about 0.1 wt. % and about 20 wt. % in solution, more preferably between about 1 wt. % and about 10 wt. %. To achieve these concentrations using a fluoropolymer particle source dispersed in a solvent, such as Teflon® TE-5070AN, for example, this concentration in the plating bath may be achieved by adding between about 1.5 g and about 350 g of 60 wt. % PTFE dispersion per 1 L of electrolytic plating solution, more preferably between about 15 g and about 170 g of 60 wt. % PTFE dispersion per 1 L of electrolytic plating solution. In volume terms, the concentrations in the plating bath may be achieved by adding PTFE dispersion to the solution at a volume of between about 0.5 mL and about 160 mL of PTFE dispersion per 1 L of electrolytic plating solution, more preferably between about 6 mL and about 80 mL of PTFE dispersion per 1 L of electrolytic plating solution.

In addition to the non-metallic particles having the pre-mix coating comprising surfactant thereon, the electrolytic plating composition may comprise a source of $Sn^{2+}$ ions, an anti-oxidant, an acid, and a solvent. Typically, the solvent is water, but it may be modified to contain a small concentration of organic solvents. To plate a composite coating further comprising an alloying metal(s), the composition may also comprise a source of alloying metal ions. That is, the method of the present invention may be used to deposit composite coatings comprising tin, non-metallic particles, and an alloying metal selected from among bismuth, zinc, silver, copper, lead, and combinations thereof. Accordingly, the electrolytic plating composition may further comprise a source of alloying metal ions selected from among a source of $Bi^{3+}$ ions, a source of $Zn^{2+}$ ions, a source of $Ag^{+}$ ions, a source of $Cu^{2+}$ ions, a source of $Pb^{2+}$ ions, and combinations thereof.

The source of $Sn^{2+}$ ions may be a soluble anode comprising a $Sn^{2+}$ salt, or, where an insoluble anode is used, a soluble $Sn^{2+}$ salt. In one embodiment, the $Sn^{2+}$ salt is $Sn(CH_3SO_3)_2$ (Tin methane sulfonic acid, hereinafter "$Sn(MSA)_2$"). $Sn(MSA)_2$ is a preferred source of $Sn^{2+}$ ions because of its high solubility. Additionally, the pH of Sn plating baths of the present invention may be lowered using methane sulfonic acid, and the use of $Sn(MSA)_2$ as the Sn source rather than, e.g., Sn(X), avoids the introduction of unnecessary additional anions, e.g., $X^{2-}$, into the plating baths. In another embodiment, the source of $Sn^{2+}$ ions is tin sulfate, and the pH of the Sn plating bath is lowered using sulfuric acid. Typically, the concentration of the source of $Sn^{2+}$ ions is sufficient to provide between about 10 g/L and about 100 g/L of $Sn^{2+}$ ions into the bath, preferably between about 15 g/L and about 95 g/L, more preferably between about 40 g/L and about 60 g/L. For example, $Sn(MSA)_2$ may be added to provide between about 30 g/L and about 60 g/L $Sn^{2+}$ ions to the plating bath, such as between about 40 g/L and about 55 g/L $Sn^{2+}$ ions (about 100 to 145 g/L as $Sn(MSA)_2$), such as between about 40 g/L and about 50 g/L $Sn^{2+}$ ions (about 100 to 130 g/L as $Sn(MSA)_2$). In another embodiment, $Sn(MSA)_2$ may be added to provide between about 60 g/L and about 100 g/L $Sn^{2+}$ ions to the plating bath, (about 155 to 265 g/L as $Sn(MSA)_2$).

Anti-oxidants may be added to the electrolytic plating compositions of the present invention to stabilize the composition against oxidation of $Sn^{2+}$ ions in solution to $Sn^{4+}$ ions. Reduction of $Sn^{4+}$, which forms stable hydroxides and oxides, to Sn metal, being a 4-electron process, slows the reaction kinetics. Accordingly, preferred anti-oxidants including hydroquinone, catechol, any of the dihydroxyl, and trihydroxylbenzenes, and any of the hydroxyl, dihydroxyl, or trihydroxylbenzoic acids can be added in a concentration between about 0.1 g/L and about 10 g/L, more preferably between about 0.5 g/L and about 3 g/L. For example, hydroquinone can be added to the bath at a concentration of about 2 g/L.

The electrolytic plating composition of the present invention preferably has an acidic pH to inhibit anodic passivation, achieve better cathodic efficiency, and achieve a more ductile deposit. Accordingly, the composition pH is preferably between about 0 and about 3, preferably about 0. The preferred pH may be achieved using sulfuric acid, nitric acid, acetic acid, and methane sulfonic acid. The concentration of the acid is preferably between about 50 g/L and about 300 g/L, such as between about 50 g/L and about 225 g/L, such as between about 50 g/L and about 200 g/L, preferably between about 70 g/L and about 150 g/L (such as about 135 g/L), more preferably between about 70 g/L and about 120 g/L, and in some embodiments, between about 150 g/L and about 225 g/L. The methanesulfonic acid may be added as a solid material, or from a 70 wt. % solution in water, both of which are available from Sigma-Aldrich. For example, between about 50 g/L and about 160 g/L methane sulfonic acid may be added to the electrolytic plating composition to achieve a composition pH 0 and act as the conductive electrolyte.

For plating a composite coating comprising tin, non-metallic particles, and bismuth, a source of $Bi^{3+}$ ions is included in the composition. Sources of bismuth include bismuth sulfate, and salts of alkylsulfonates, such as bismuth methanesulfonate. Typically, the concentration of the source of $Bi^{3+}$ ions is sufficient to provide between about 1 g/L and about 30 g/L of $Bi^{3+}$ ions into the bath, preferably between about 5 g/L and about 20 g/L. A composite coating deposited from a composition comprising a source of $Bi^{3+}$ ions may yield a coating having between about 1% by weight and about 60% by weight bismuth, with bismuth contents from about 1% by weight to about 5% by weight in some composite coatings and between about 50% by weight and about 60% by weight in other composite coatings.

For plating a composite coating comprising tin, non-metallic particles, and zinc, a source of $Zn^{2+}$ ions is included in the composition. The zinc ion may be present in the bath in the form of a soluble salt such as zinc methanesulfonate, zinc sulfate, zinc chloride, stannous fluoride, zinc fluoroborate, zinc sulfamate, zinc acetate, and others. Typically, the concentration of the source of $Zn^{2+}$ ions is sufficient to provide between about 0.1 g/L and about 20 g/L of $Zn^{2+}$ ions into the bath, preferably between about 0.1 g/L and about 6 g/L. A composite coating deposited from a composition comprising a source of $Zn^{2+}$ ions may yield a coating having between about 5% by weight and about 35% by weight zinc, typically between about 7% by weight and about 10% by weight in some composite coatings, or as high as between about 25% by weight and about 30% by weight in corrosion-resistant composite coatings.

For plating a composite coating comprising tin, non-metallic particles, and silver, a source of $Ag^{+}$ ions is included in the composition. Silver compounds include silver salts of the sulfonic acids such as methanesulfonic acid, as well as, silver sulfate, silver oxide, silver chloride, silver nitrate, silver bromide, silver iodide, silver phosphate, silver pyrophosphate, silver acetate, silver formate, silver citrate, silver gluconate, silver tartrate, silver lactate, silver succinate, silver sulfamate, silver tetrafluoroborate and silver hexafluorosilicate. Each of these silver compounds may be used individually or in a mixture of two or more of them. Typically, $Ag^+$ ions are sparingly soluble with most anions. Therefore, the source of $Ag^+$ ions is preferably limited to salts of nitrate, acetate, and preferably methane sulfonate. Typically, the concentration of the source of $Ag^+$ ions is sufficient to provide between about 0.1 g/L and about 1.5 g/L of $Ag^+$ ions into the bath, preferably between about 0.3 g/L and about 0.7 g/L, more preferably between about 0.4 g/L and about 0.6 g/L. For example, Ag(MSA) may be added to provide between about 0.2 g/L and about 1.0 g/L $Ag^+$ ions to the plating bath. A composite coating deposited from a composition comprising a source of $Ag^+$ ions may yield a coating having between about 1% by weight and about 10% by weight silver, more typically from about 2% by weight to about 5% by weight.

For plating a composite coating comprising tin, non-metallic particles, and copper, a source of $Cu^{2+}$ ions is included in the composition. Exemplary sources of $Cu^{2+}$ ions include a variety of organic and inorganic salts, such as copper methanesulfonate, copper sulfate, copper oxide, copper nitrate, copper chloride, copper bromide, copper iodide, copper phosphate, copper pyrophosphate, copper acetate, copper formate, copper citrate, copper gluconate, copper tartrate, copper lactate, copper succinate, copper sulfamate, copper tetrafluoroborate and copper hexafluorosilicate, and hydrates of the foregoing compounds. Typically, the concentration of the source of $Cu^{2+}$ ions is sufficient to provide between about 0.1 g/L and about 2.0 g/L of $Cu^{2+}$ ions into the bath, preferably between about 0.2 g/L and about 1.0 g/L, such as about 0.3 g/L. A composite coating deposited from a composition comprising a source of $Cu^{2+}$ ions may yield a coating having between about 1% by weight and about 10% by weight copper, more typically between about 1% by weight and about 3% by weight.

For plating a composite coating comprising tin, non-metallic particles, and lead, a source of $Pb^{2+}$ ions is included in the composition. Exemplary sources of $Pb^{2+}$ ions include a variety of organic and inorganic salts, such as lead sulfate, lead methanesulfonate and other lead alkylsulfonates, and lead acetate. Typically, the concentration of the source of $Pb^{2+}$ ions is sufficient to provide between about 2 g/L and about 30 g/L of $Pb^{2+}$ ions into the bath, preferably between about 4 g/L and about 20 g/L, more preferably between about 8 g/L and about 12 g/L. A composite coating deposited from a composition comprising a source of $Pb^{2+}$ ions may yield a coating having between about 20% by weight and about 45% by weight lead, more typically around 37% by weight to about 40% by weight (eutectic tin-lead solder).

The tin-based composite coating can be plated using the Stannostar® chemistry available from Enthone Inc. of West Haven, Conn. employing Stannostar® additives (e.g., wetting agent 300, C1, C2, or others). For bright tin-based composite coatings, Stannostar® 1405 is one exemplary tin plating chemistry. For matte finishes, the tin-based composite coatings can be plated using the Stannostar® 2705 chemistry or the sulfate-based Stannostar® 3805 chemistry. Other conventionally known bright or matte tin plating chemistries are applicable to plate the tin-based composite coatings of the present invention. To plate a tin-based composite coating further comprising Bi, the Stannostar® SnBi chemistry can be used. To plate a tin-based composite coating further comprising Cu, the Stannostar® GSM chemistry may be used. A tin-based composite coating further comprising Ag can be plated using the chemistry disclosed in U.S. Pub. No. 2007/0037377.

During the electrolytic plating operation of the invention, electrons are supplied from an external source of electrons to a substrate, which acts as a cathode, and therefore, the site of reduction. The plating composition is preferably maintained at a temperature between about 20° C. and about 60° C. In one preferred embodiment, the temperature is between about 25° C. and about 35° C. The substrate is immersed in or otherwise exposed to the plating bath. The current density applied is between about 1 A/dm$^2$ (Amps per square decimeter, hereinafter "ASD") and about 100 ASD, preferably between about 1 ASD and about 20 ASD, more preferably between about 10 ASD and about 15 ASD. Lower current densities are preferred since higher current densities may generate foam in the composition and yield a dark deposit. The plating rate is typically between about 0.05 μm/min and about 50 μm/min, with typical plating rates of about 5 μm/min and about 6 μm/min achieved at 15 ASD and typically about 4.5 μm/min at 10 ASD. Typically, the thickness of the electrolytically deposited composite coating is between about 1 μm and about 100 μm, more preferably between about 1 μm and about 10 μm, even more preferably about 3 μm thick.

The anode may be a soluble anode or insoluble anode. If a soluble anode is used, the anode preferably comprises $Sn(MSA)_2$, such that the source of $Sn^{2+}$ ions in the plating bath is the soluble anode. Use of a soluble anode is advantageous because it allows careful control of the $Sn^{2+}$ ion concentration in the bath, such that the $Sn^{2+}$ ion does not become either under- or over-concentrated. An insoluble anode may be used instead of a Sn-based soluble anode. Preferable insoluble anodes include Pt/Ti, Pt/Nb, and DSAS (dimensionally stable anodes). If an insoluble anode is used, the $Sn^{2+}$ ions are introduced as a soluble $Sn^{2+}$ salt.

During the electrolytic plating operation, $Sn^{2+}$ ions are depleted from the electrolytic plating composition due to their reduction to tin metal in the composite coating. Rapid depletion can occur especially with the high current densities achievable with the plating baths of the present invention. Therefore, $Sn^{2+}$ ions can be replenished according to a variety of methods. If a Sn-based soluble anode is used, the $Sn^{2+}$ ions are replenished by the dissolution of the anode during the plating operation. If an insoluble anode is used, the electrolytic plating composition may be replenished according to continuous mode plating methods or use-and-dispose plating methods. In the continuous mode, the same bath volume is used to treat a large number of substrates. In this mode, reactants must be periodically replenished, and reaction products accumulate, necessitating periodic filtering of the plating bath. Alternatively, the electrolytic plating compositions according to the present invention are suited for so-called "use-and-dispose" deposition processes. In the use-and-dispose mode, the plating composition is used to treat a substrate, and then the bath volume is directed to a waste stream. Although this latter method may be more expensive, the use-and-dispose mode requires no metrology, that is, measuring and adjusting the solution composition to maintain bath stability is not required.

The mechanism of deposition is co-deposition of the non-metallic particles and the metal particles. For example, a fluoropolymer particle is not reduced, but is trapped at the interface by the reduction of the metal ions, which reduce and deposit around the fluoropolymer particle. The surfactants assist by imparting a charge to the fluoropolymer particles, which helps to sweep them toward the cathode and temporarily and lightly adhere them to the surface until encapsulated and trapped there by the reducing metal ions. The imparted charge is typically positive since the substrate upon which the composite coating is plated is the cathode during an electrolytic plating operation.

The electrolytic plating compositions can be used to plate bright, glossy composite coatings or matte composite coatings on substrates, particularly electronic components. The composite coatings comprise non-metallic particle in an amount between about 0.1 wt. % and about 10 wt. % of the mass of the coating, preferably between about 0.5 wt. % and about 5 wt. %, even more preferably between about 1 wt. % and about 5 wt. %. Preferably, the non-metallic particles are distributed substantially evenly throughout the plated deposit. The composite coatings comprising these non-metallic particle amounts are characterized by increased wear resistance, increased corrosion resistance, a decreased friction coefficient, and an increased resistance to tin whiskers. The metal and fluorine content of pure tin coatings, tin-based composite coatings comprising non-metallic particles, and tin-based composite coatings comprising non-metallic particles and another metal can be determined by energy dispersive x-ray spectroscopy (EDS).

In one embodiment, the composite coatings comprising tin non-metallic particles are deposited by an electroless or immersion plating method. The plating solution for electroless/immersion tin may be conventional. For example, an electroless/immersion tin composition may include a source of tin ions, a mineral acid, a carboxylic acid, an alkanesulfonic acid, a complexing agent and water. Tin ion sources include those listed above, for example, tin methanesulfonate, tin oxide, and other tin salts. The tin ion concentration may be between about 1 g/L to about 120 g/L, but may be as high as the solubility limit of the particular tin salt in the particular solution. The tin ion concentration may be between about 5 g/L and about 80 g/L, preferably between about 10 g/L and about 50 g/L. In one embodiment, the tin ion concentration is between about 20 g/L and about 40 g/L, such as about 30 g/L, or about 20 g/L. In another embodiment, the tin ion concentration is between about 40 g/L and about 50 g/L.

Acids include mineral acids, carboxylic acids, alkanesulfonic acids, and combinations thereof. For example, one or more organic acids such as tartaric acid and/or citric acid may be added in a concentration between about 200 g/L to about 400 g/L. Alkanesulfonic acids include methanesulfonic acid, ethanesulfonic acid, ethanedisulfonic acid, and methanedisulfonic acid, among others. Methane sulfonic acid may be added, for example, in a concentration between about 50 g/L to about 225 g/L, between about 50 g/L to about 150 g/L, between about 60 g/L and about 100 g/L, such as about 70 g/L, about 100 g/L, about 110 g/L, about 120 g/L, about 130 g/L, about 135 g/L, or about 140 g/L, or between about 150 g/L and about 225 g/L. In another embodiment, fluoboric acid is present in an amount of about 70 g/L. In another embodiment, fluoboric acid is present in an amount of about 100 g/L. In another embodiment, sulfuric acid is present in an amount of about 150 g/L. The acid may be added to achieve a solution with a pH between about 0 to about 3, such as about 0 to about 2, such as about 0 to about 1, or even between about 0 to about −1. Generally, it is desirable to use an acid that has an anion common to the acid salts of the metals.

The composite coatings of the present invention further demonstrate an enhanced resistance to tin whisker formation. Tin whisker resistance can be measured by accelerating the aging of the tin-based composite coatings. For example, the tin-based composite coatings can be aged at room temperature under ambient composition and pressure for 4 months and then at 50° C. for 2 months. After aging, the tin-based composite coatings comprising particles show enhanced resistance to tin whisker formation compared to pure tin deposits.

The following examples further illustrate the present invention.

Example 1

Electrolytic Plating Composition for Depositing a Composite Coating Comprising Tin and Fluoropolymer Particles A composition for electrolytically plating a bright, glossy tin-based composite coating comprising fluoropolymer particles was prepared comprising the following components:

100-145 g/L $Sn(CH_3SO_3)_2$ (40 to 55 g/L $Sn^2$% ions)
150-225 mL/L $CH_3SO_3H$ (70% methane sulfonic acid solution in water)
20 mL/L PTFE dispersion
80-120 mL/L Stannostar® 1405 Additives The pH of the composition was about 0. One liter of this composition was prepared. The PTFE dispersion used in this Example and in Example 2 is the 5070AN dispersion available from DuPont which comprises nanoparticles and a non-ionic surfactant. The Stannostar additives include a cationic surfactant. So in Examples 1 and 2 the particles are pre-wet with the non-ionic surfactant, but are not pre-wet with the cationic surfactant.

Example 2

Electrolytic Plating Composition for Depositing a Composite Coating Comprising Tin and Fluoropolymer Particles A composition for electrolytically plating a bright, glossy tin-based composite coating comprising fluoropolymer nanoparticles was prepared comprising the following components:

100-145 g/L $Sn(CH_3SO_3)_2$ (40 to 55 g/L $Sn^2$% ions)
150-225 mL/L $CH_3SO_3H$ (70% methane sulfonic acid solution in water)
40 mL/L PTFE dispersion
80-120 mL/L Stannostar® 1405 Additives The pH of the composition was about 0. One liter of this composition was prepared.

Comparative Example 3

Electrolytic Plating Composition for Depositing a Pure Tin Layer

A composition for electrolytically plating a bright, glossy pure tin coating was prepared comprising the following components:

100-145 g/L $Sn(CH_3SO_3)_2$ (40 to 55 g/L $Sn^{2+}$ ions)
150-225 mL/L $CH_3SO_3H$ (70% methane sulfonic acid solution in water)
80-120 mL/L Stannostar® 1405 Additives The pH of the composition was about 0. One liter of this composition was prepared.

Example 4

Figure 2:
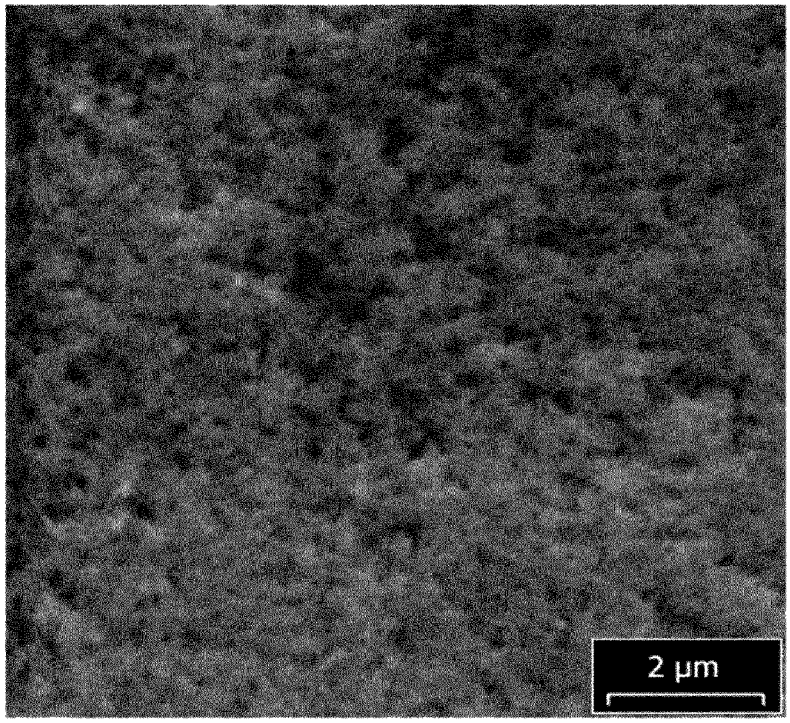
FIG. 2 is a SEM image of a tin-based composite coating comprising fluoropolymer particles deposited according to the method of Example 4. The electrolytic plating bath comprised 20 mL of PTFE dispersion.
Figure 3:
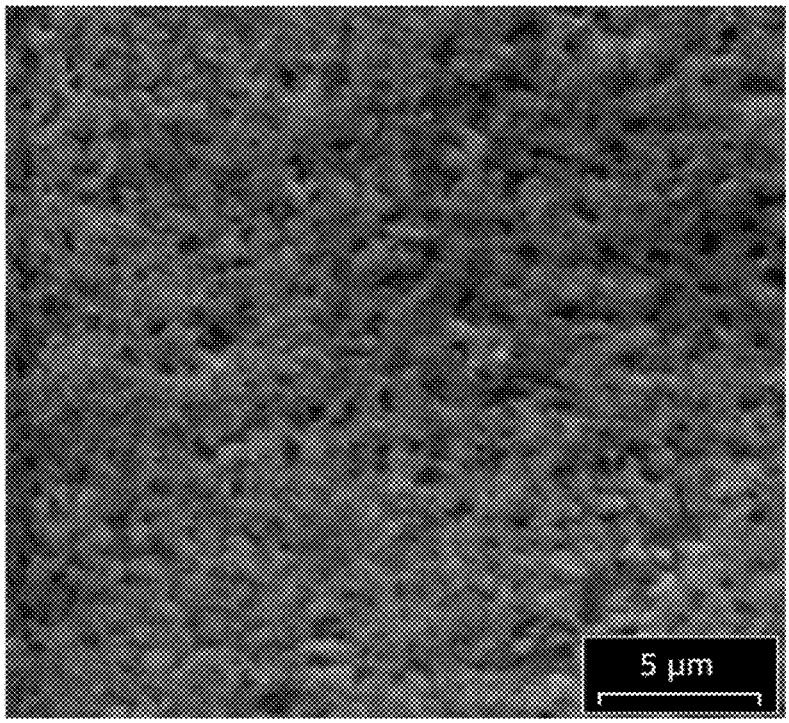
FIG. 3 is a SEM image of a tin-based composite coating comprising fluoropolymer particles deposited according to the method of Example 4. The electrolytic plating bath comprised 40 mL of PTFE dispersion.

Electrolytic Deposition of a Pure Tin Layer and a Composite Coating Comprising Tin and Fluoropolymer Particles Two bright composite coatings comprising tin fluoropolymer nanoparticles (using the electrolytic plating compositions of Examples 1 and 2) and one bright, pure tin deposit (using the electrolytic plating composition of Example 3) were plated onto copper foils. The samples were plated in a beaker and the agitation was provided using a stir bar. To deposit the composite coatings comprising tin and fluoropolymer nanoparticles, the applied current density was 15 ASD, the plating duration was 50 seconds, and the deposit thickness was 5 micrometers, for a plating rate 6 micrometers per minute. SEM images of the freshly deposited composite coatings were obtained and are shown in FIG. 2 (composite coating obtained from composition of Example 1, scale=2 μm) and in FIG. 3 (composite coating obtained from composition of Example 2, scale=5 μm).

Figure 4A:
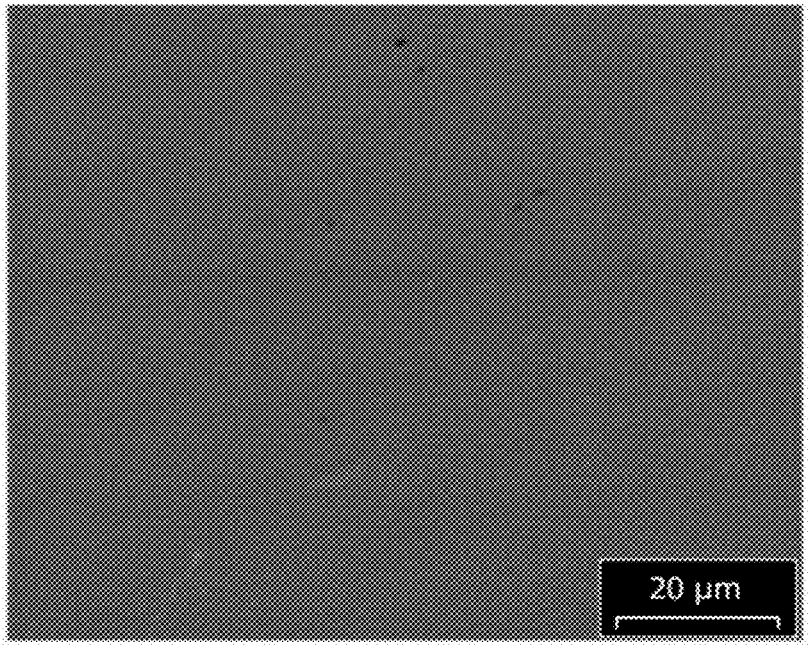
FIGS. 4A, 4B, and 4C are SEM images of a bright pure tin coating deposited according to the method of Example 4.
Figure 4B:
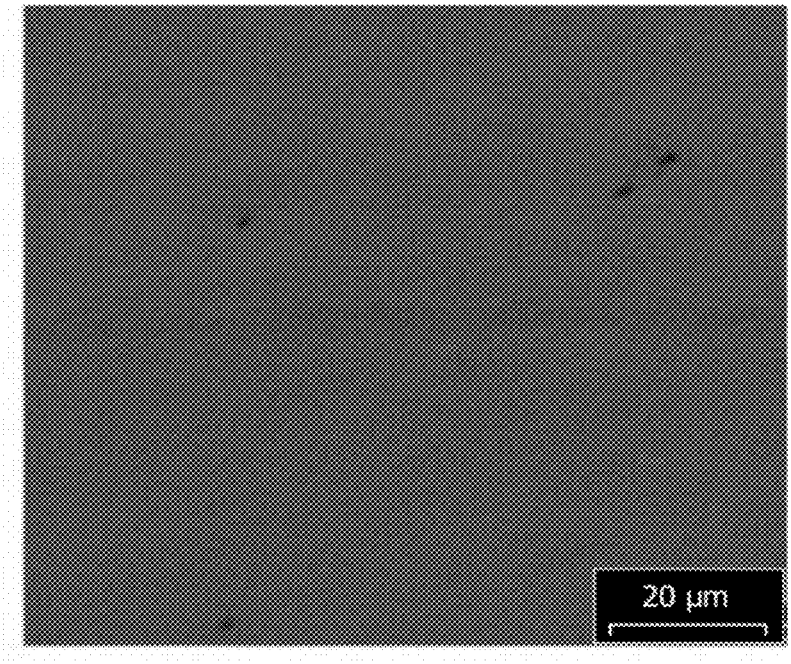
Figure 4C:
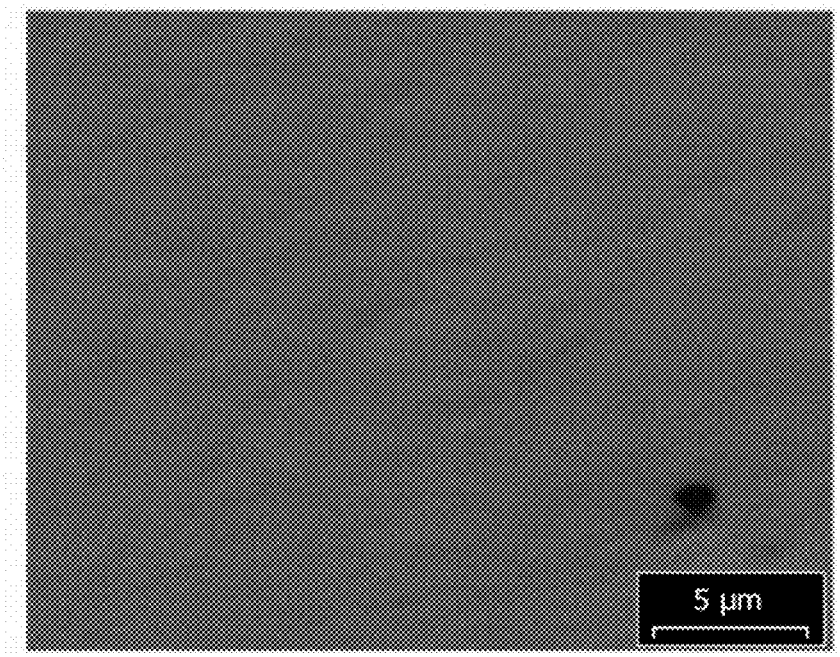

To deposit the pure tin coating from the electrolytic composition of Comparative Example 3 to achieve a bright tin deposit, the applied current density was 15 ASD, the plating duration was 50 seconds, and the deposit thickness was 5 micrometers. Accordingly, the plating rate was 6 micrometers per minute. Three SEM images of the freshly deposited pure, bright tin coating were obtained and are shown in FIG. 4A (500× magnification, scale=20 μm), FIG. 4B (1000× magnification, scale=20 μm), and FIG. 4C (3000× magnification, scale=5 μm).

Example 5

Figure 5A:
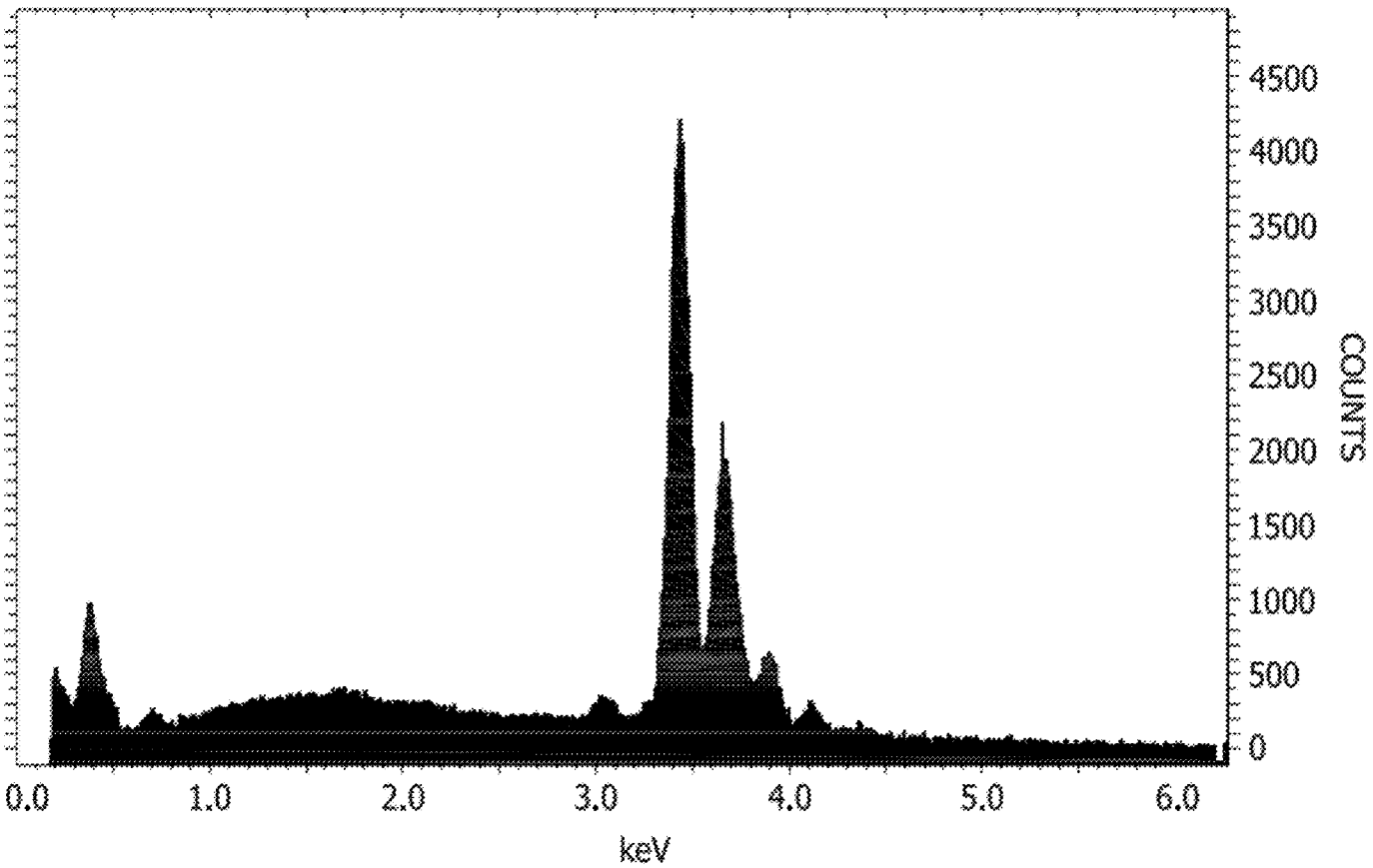
FIGS. 5A and 5B are an EDS spectra of a pure tin deposit acquired according to the method of Example 5.
Figure 5B:
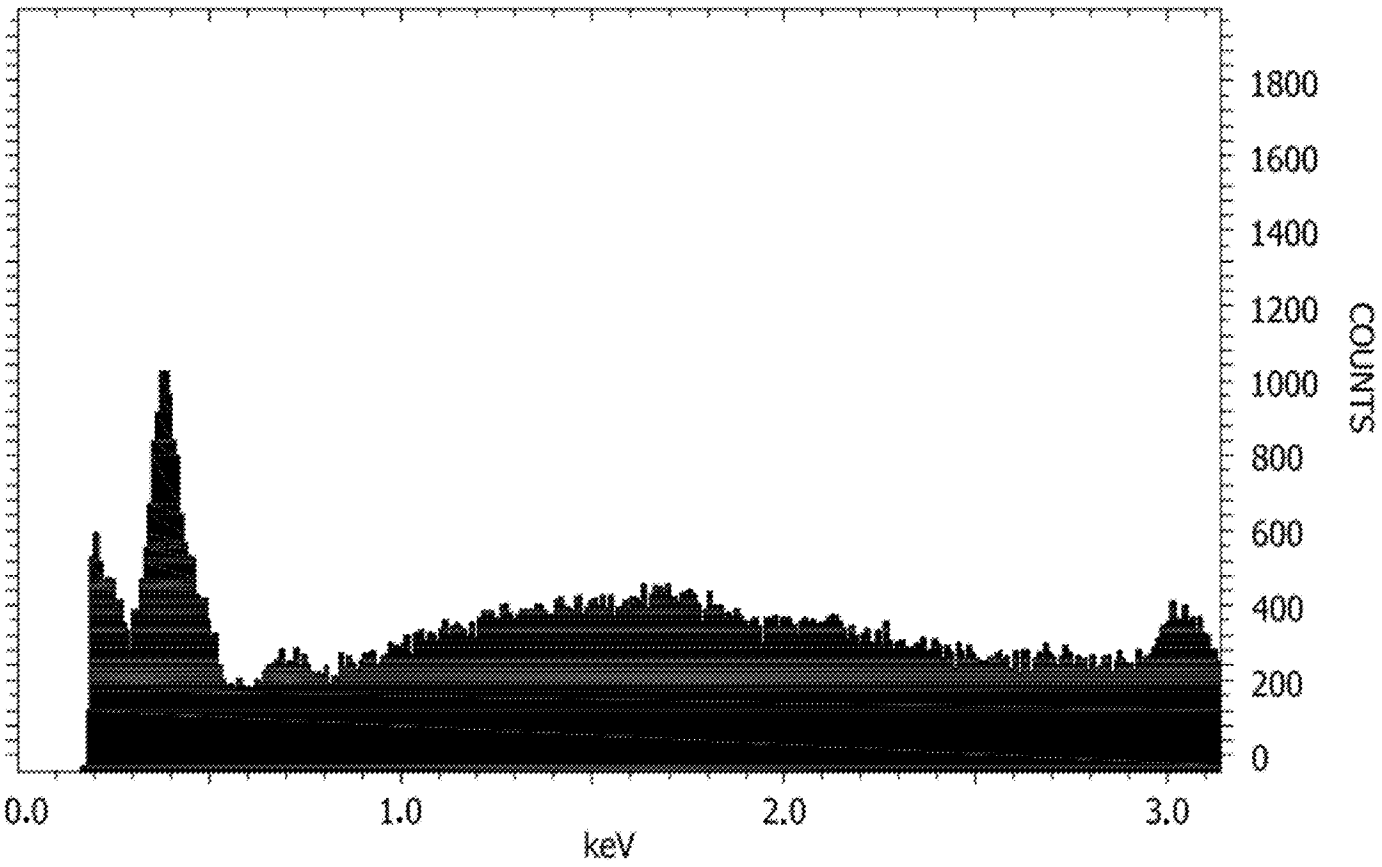

Measurement of Tin Content in a Pure Tin Layer and Measurement of Tin and Fluoropolymer Content in Composite Coatings The deposits plated according to the method of Example 4 were measured for tin and fluorine content using Energy Dispersive Spectroscopy (EDS). FIG. 5A is an EDS spectrum scan from 0.0 keV to about 6 keV (extracted from a scan range of 0 to 10 keV) of a pure tin coating deposited using the electrolytic composition of Comparative Example 3. The large peak spanning from 3.2 kev to 4.0 keV is characteristic of tin. FIG. 5B is an EDS spectrum from 0.0 kEv to about 3 keV. No fluorine peaks are observed.

Figure 6A:
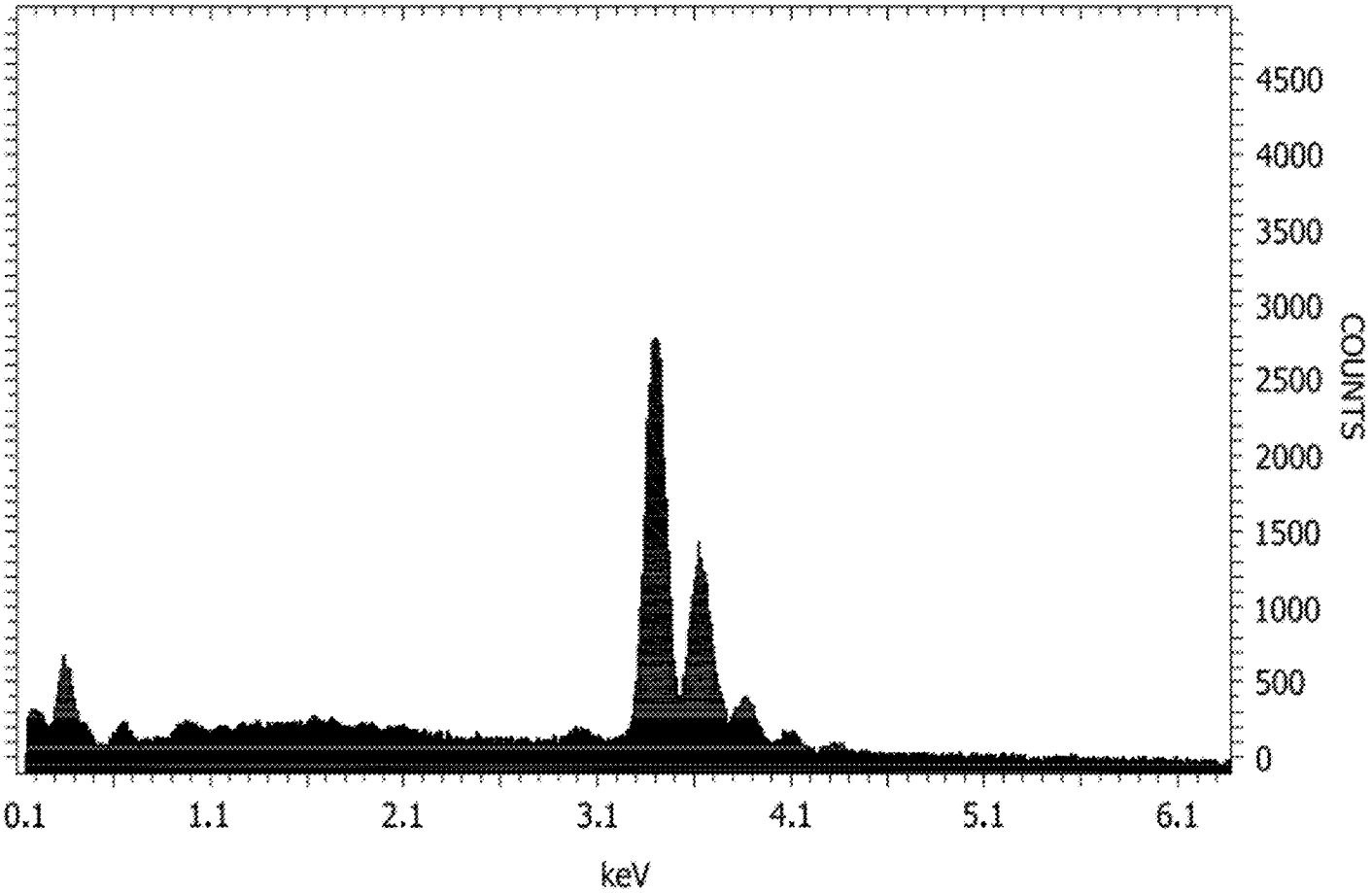
FIGS. 6A and 6B are EDS spectra of a tin-based composite coating acquired according to the method of Example 5. The electrolytic plating bath comprised 20 mL of PTFE dispersion.
Figure 7A:
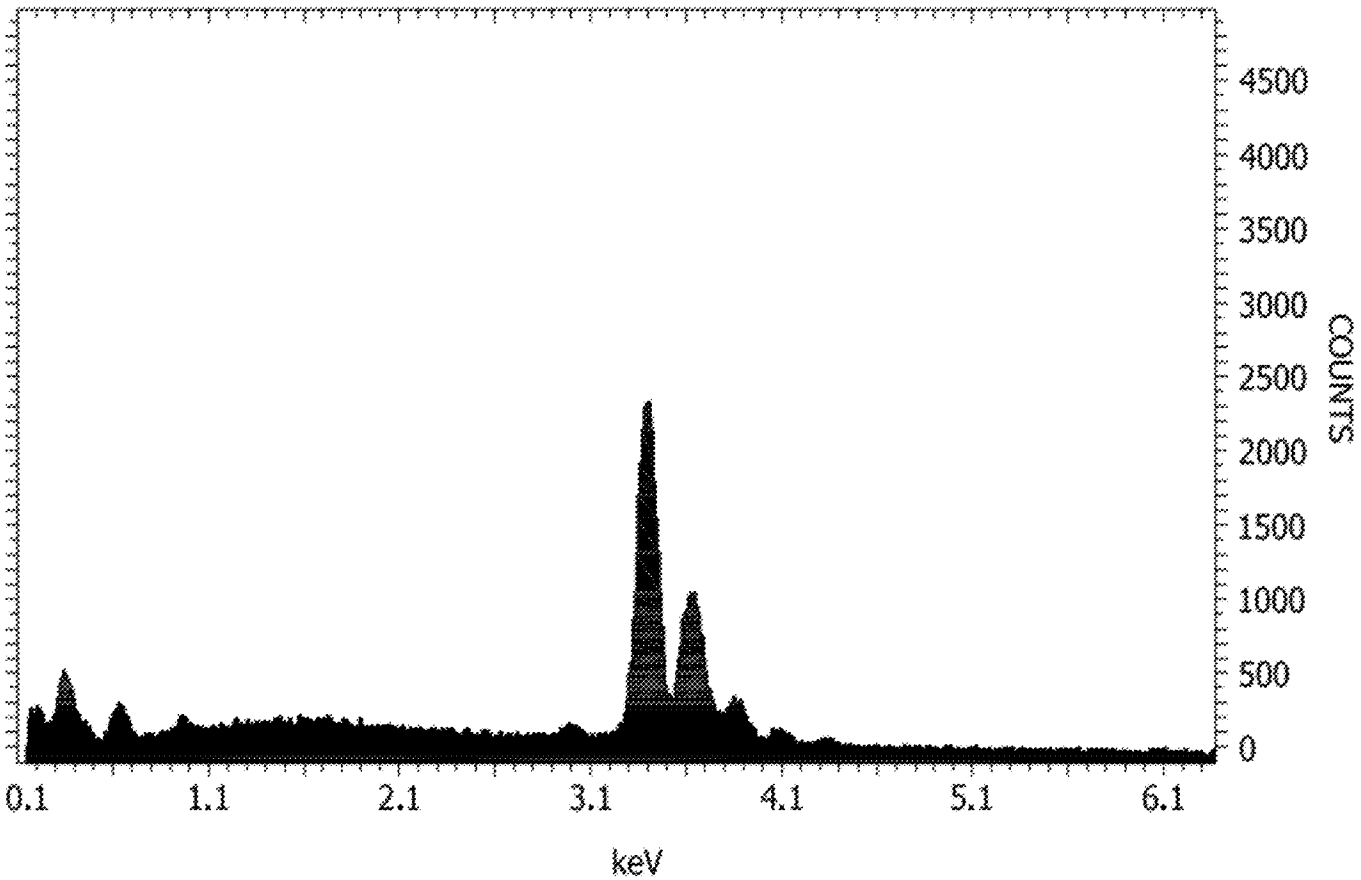
FIGS. 7A and 7B are EDS spectra of a tin-based composite coating acquired according to the method of Example 5. The electrolytic plating bath comprised 40 mL of PTFE dispersion.

FIGS. 6A (from 0.0 kEv to 6.1 keV) and 6B (0.0 kEv to about 3 keV) are EDS spectra of a composite coating comprising tin and fluoropolymer nanoparticles deposited using the electrolytic composition of Example 1. The characteristic tin peak, located from 3.2 kev to 4.0 keV, is present along with fluorine peaks, located from 0.6 kev to 0.8 keV. FIGS. 7A (from 0.0 kEv to 6.1 keV) and 7B (0.0 kEv to about 3 keV) depict EDS spectra of a composite coating comprising tin and fluoropolymer particles deposited using the electrolytic composition of Example 2. The characteristic tin peak, located from 3.2 kev to 4.0 keV, is present along with fluorine peaks, located from 0.6 kev to 0.8 keV.

Figure 6B:
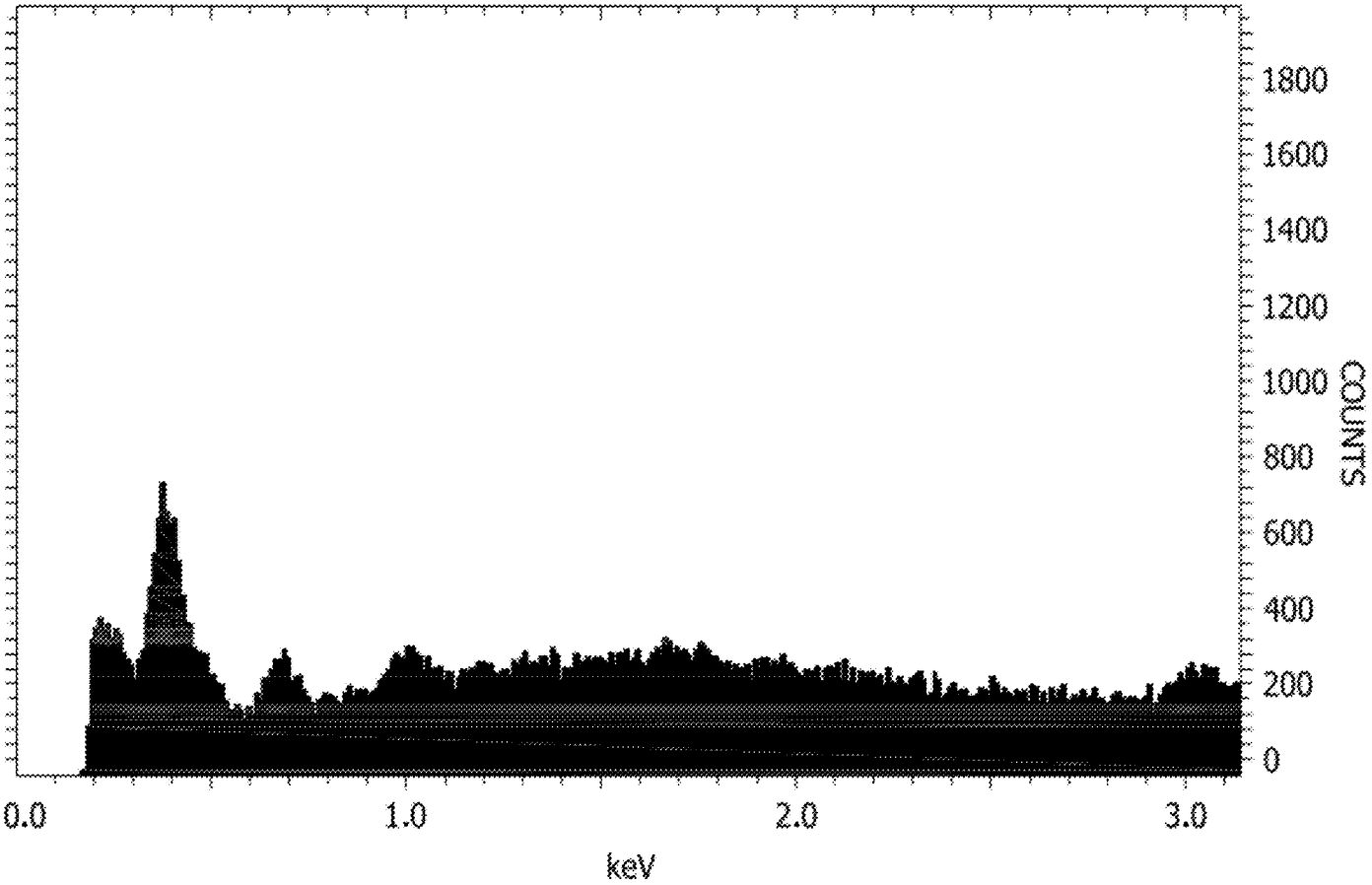
Figure 7B:
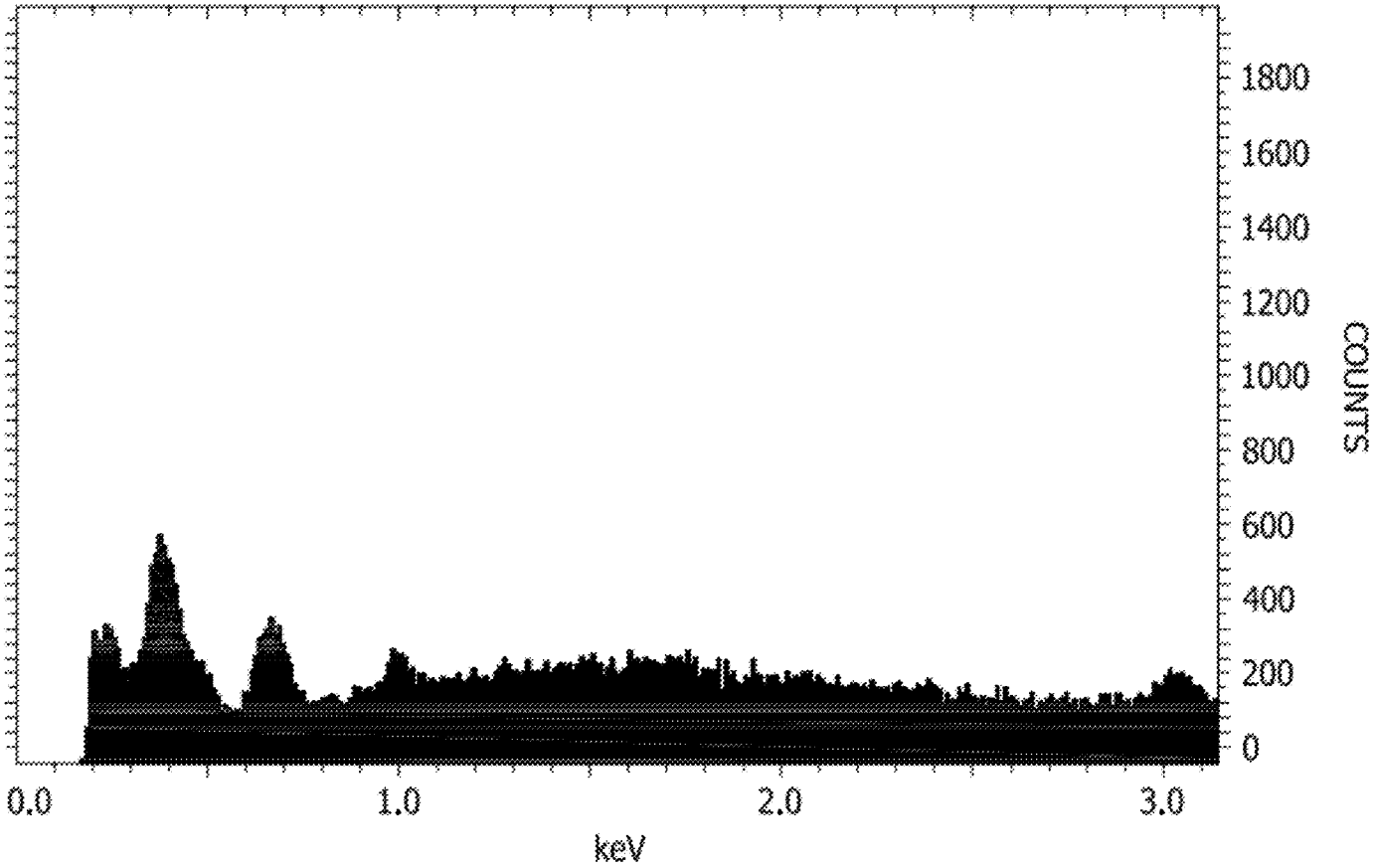

From these spectra, it is possible to quantify the tin and fluorine content of the plated deposits. The EDS spectra shown in FIGS. 5A and 5B indicate a tin content in the coating of 100% by weight, with no fluorine. The EDS spectra shown in FIGS. 6A and 6B indicate a tin content in the coating is 98.5% by weight and a fluorine content of 1.5% by weight. The EDS spectra shown in FIGS. 7A and 7B indicate a tin content in the coating of 97.4% by weight and a fluorine content of 2.6% by weight.

Example 6

Measurement of Coefficient of Friction of a Pure, Bright Tin Layer and of a Bright Composite Coating Comprising Tin and Fluoropolymer Particle A bright tin layer and a bright composite coating were analyzed for their coefficients of friction. The coefficient of friction test measured the coefficient of kinetic friction, $\mu_k$, and was measured by sliding a 25 g load across a 3 mm track for 10 cycles at 4 cycles/minute.

Figure 8A:
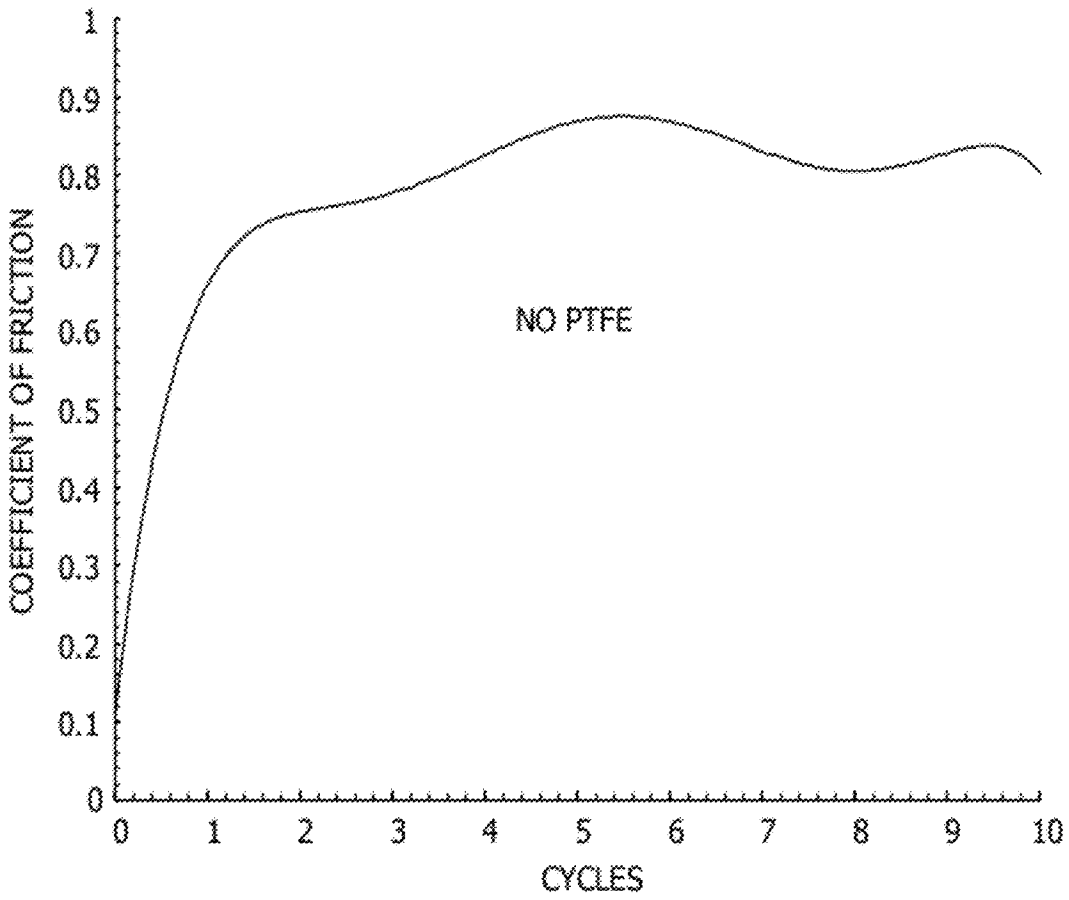
FIGS. 8A and 8B are graphs constructed from coefficient of friction data for a pure tin layer (8A) and a composite coating of the invention (8B).
Figure 8B:
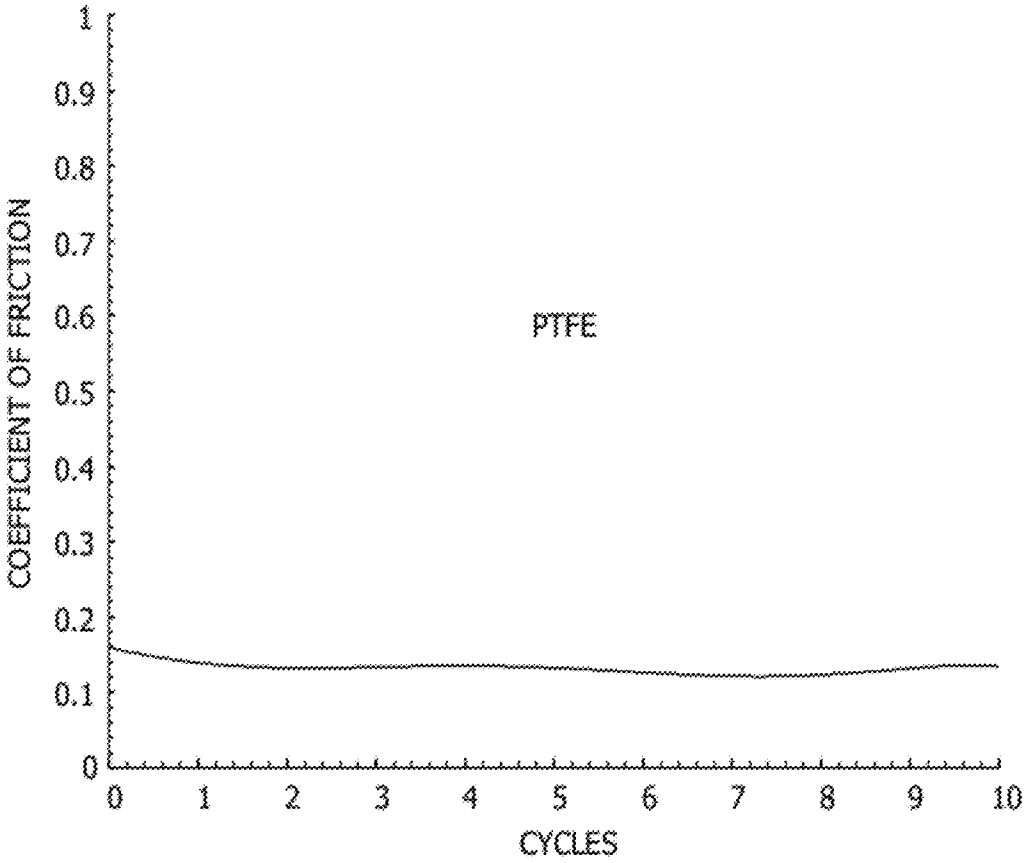

FIG. 8A is a graph constructed from data obtained from the coefficient of friction test of a pure bright tin layer. The coefficient of friction varied from 0.4 to 0.86. FIG. 8B is a graph constructed from data obtained from the coefficient of friction test of a bright composite coating obtained using the electrolytic composition of Example 1. The coefficient of friction for the composite varied from 0.11 to 0.18, which indicates its lubricity compared to the pure tin layer and its increased resistance to wear.

Example 7

Measurement of Coefficient of Friction of a Pure, Matte Tin Layer and of a Matte Composite Coating Comprising Tin and Fluoropolymer Particle A matte tin layer and matte composite coatings were analyzed for their coefficients of friction. The coefficient of friction test measured the coefficient of kinetic friction, $\mu_k$, and was measured by sliding a 25 g load across a 2.5 mm track for 10 cycles at 5 cycles/minute.

Figure 9A:
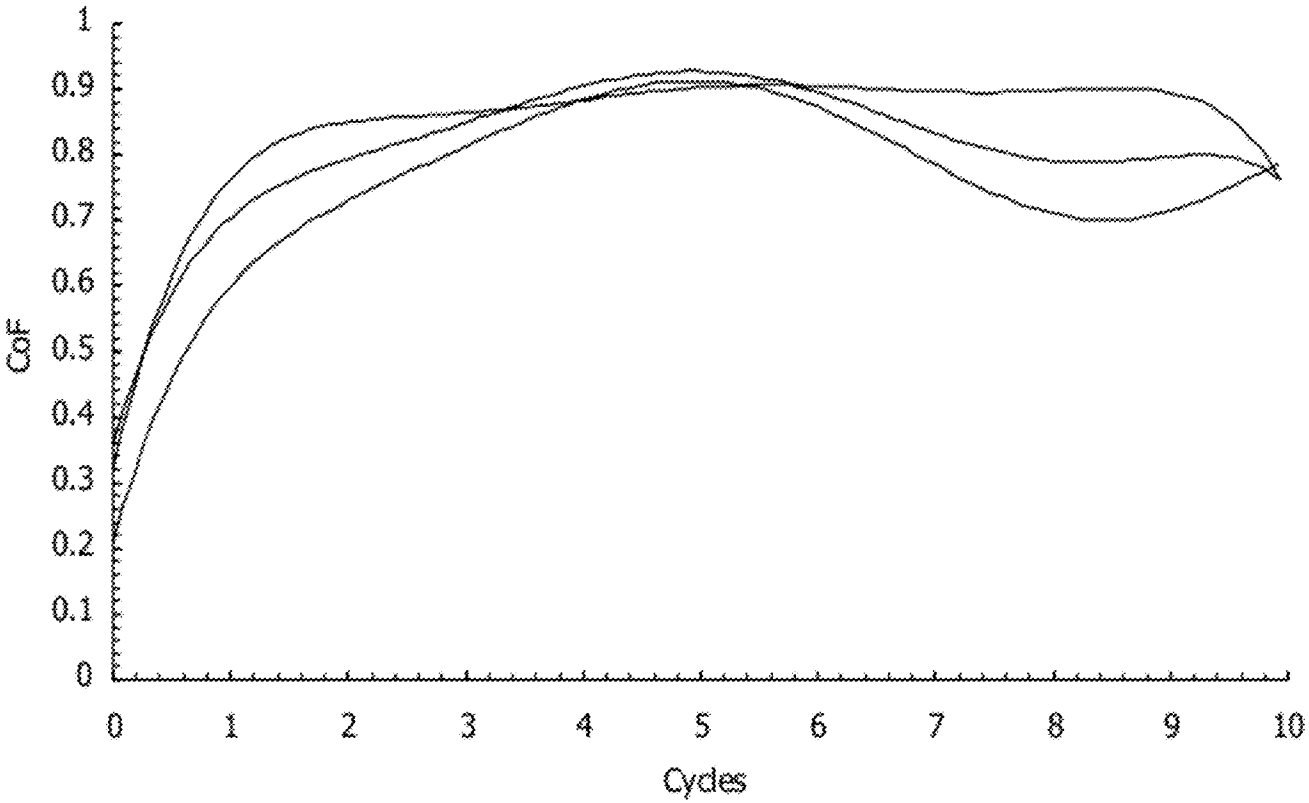
FIGS. 9A through 9C are graphs constructed from coefficient of friction data for a pure tin layer (9A) and composite coatings of the invention (9B and 9C).
Figure 9B:
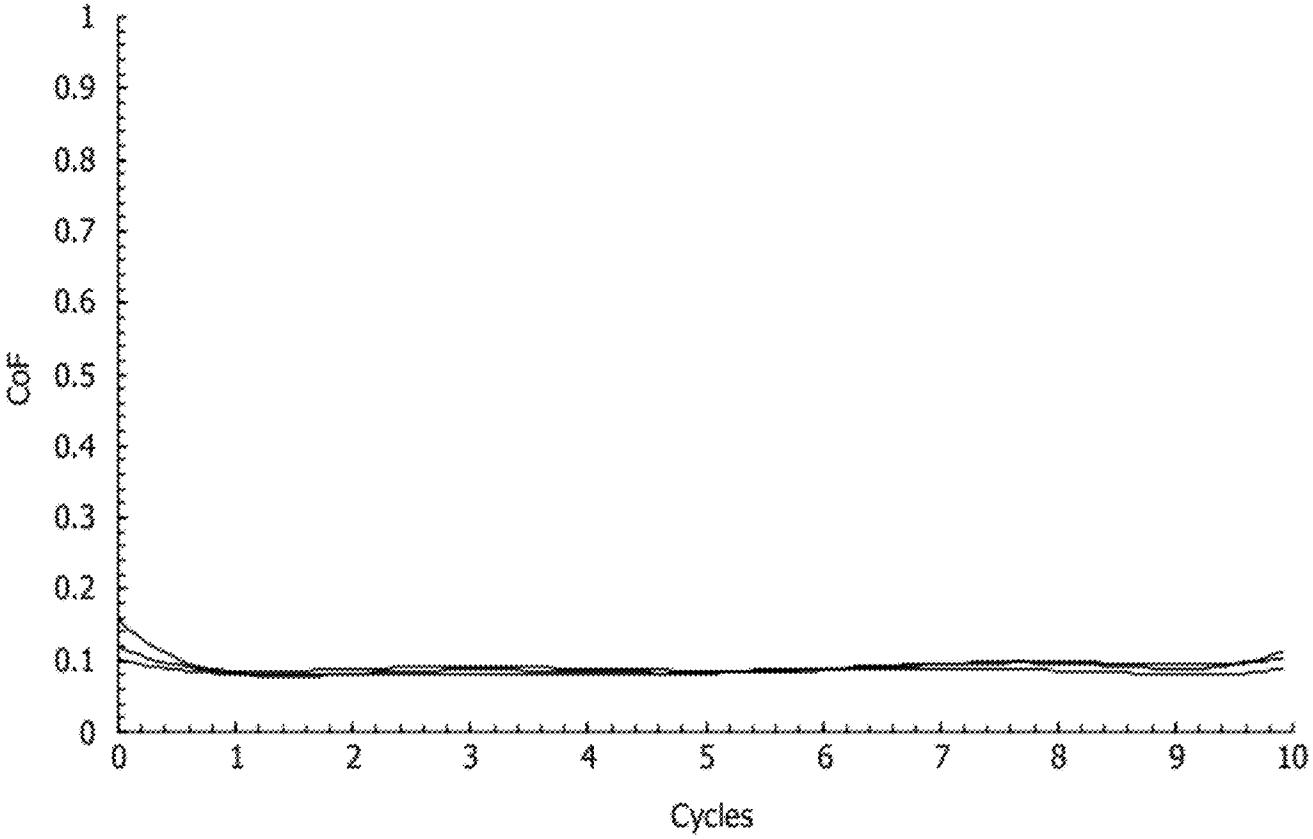
Figure 9C:
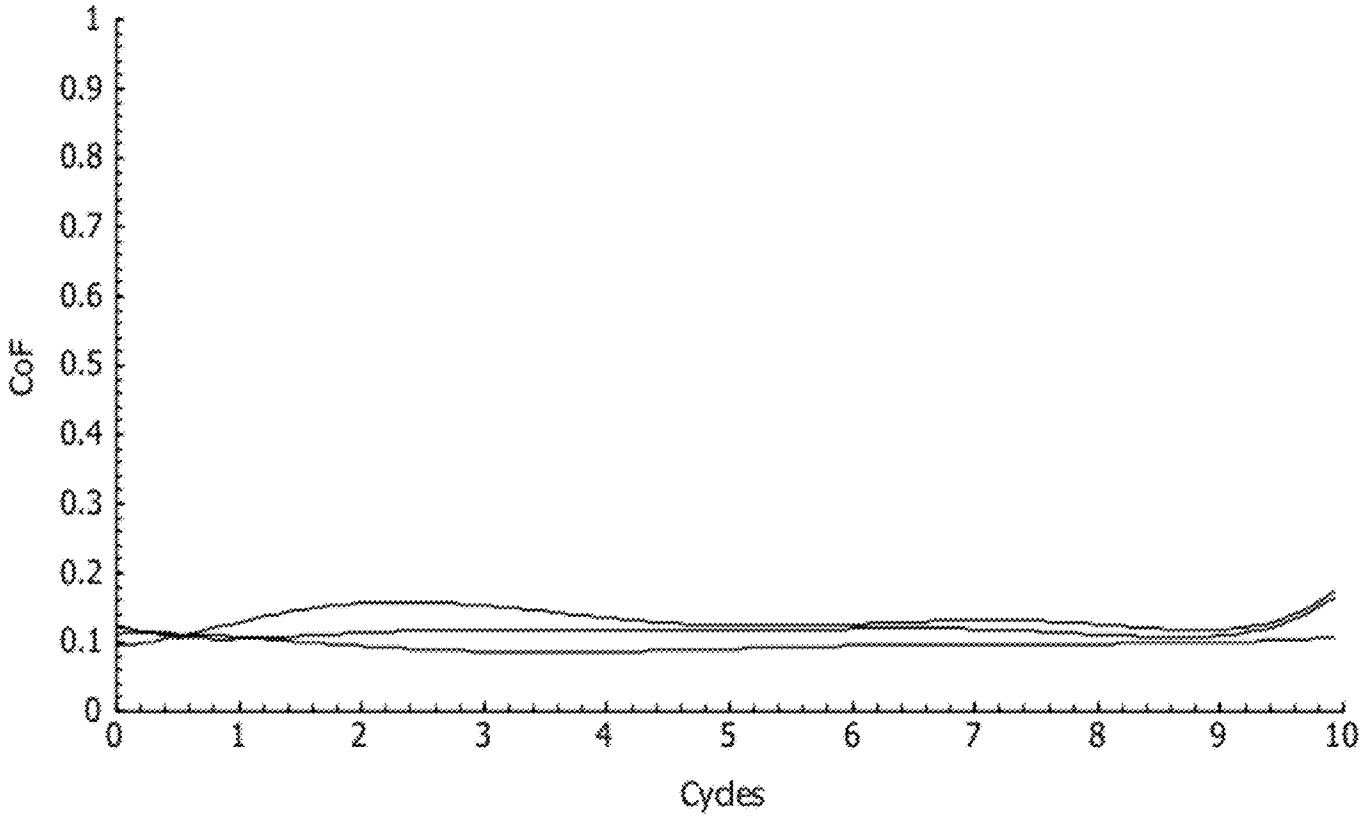

FIG. 9A is a graph constructed from data obtained from the coefficient of friction test of a pure tin layer. The coefficient of friction varied from 0.2 to 0.8. FIG. 9B is a graph constructed from data obtained from the coefficient of friction test of a composite coating obtained using the electrolytic composition of Example 1. The coefficient of friction for the composite varied from 0.10 to 0.16, which indicates its lubricity compared to the pure tin layer and its increased resistance to wear. FIG. 9C is a graph constructed from data obtained from the coefficient of friction test of a composite coating obtained using the electrolytic composition of Example 2. The coefficient of friction for the composite varied from 0.10 to 0.16, which indicates its lubricity compared to the pure tin layer and its increased resistance to wear.

Example 8

Measurement of Coefficient of Friction of a Pure, Bright Tin Layer and of Bright Tin-Based Composite Coatings Comprising Tin and Fluoropolymer Particle A pure, bright tin layer and two bright tin-based composite coatings were analyzed for their coefficients of friction. The coefficient of friction test measured the coefficient of kinetic friction, $\mu_k$, and was measured by sliding a 250 g load across a 2.5 mm track for 10 cycles at 5 cycles/minute.

Figure 10A:
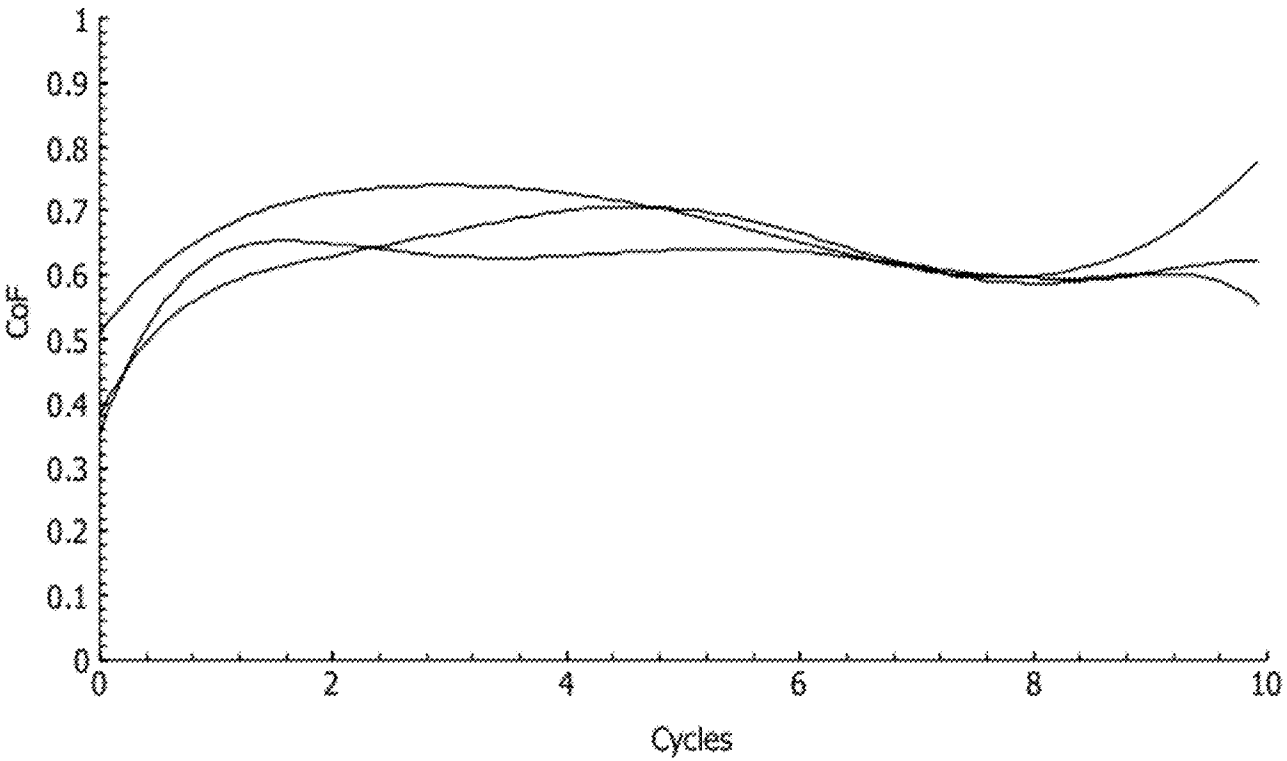
FIGS. 10A through 10C are graphs constructed from coefficient of friction data for a pure tin layer (10A) and composite coatings of the invention (10B and 10C).
Figure 10B:
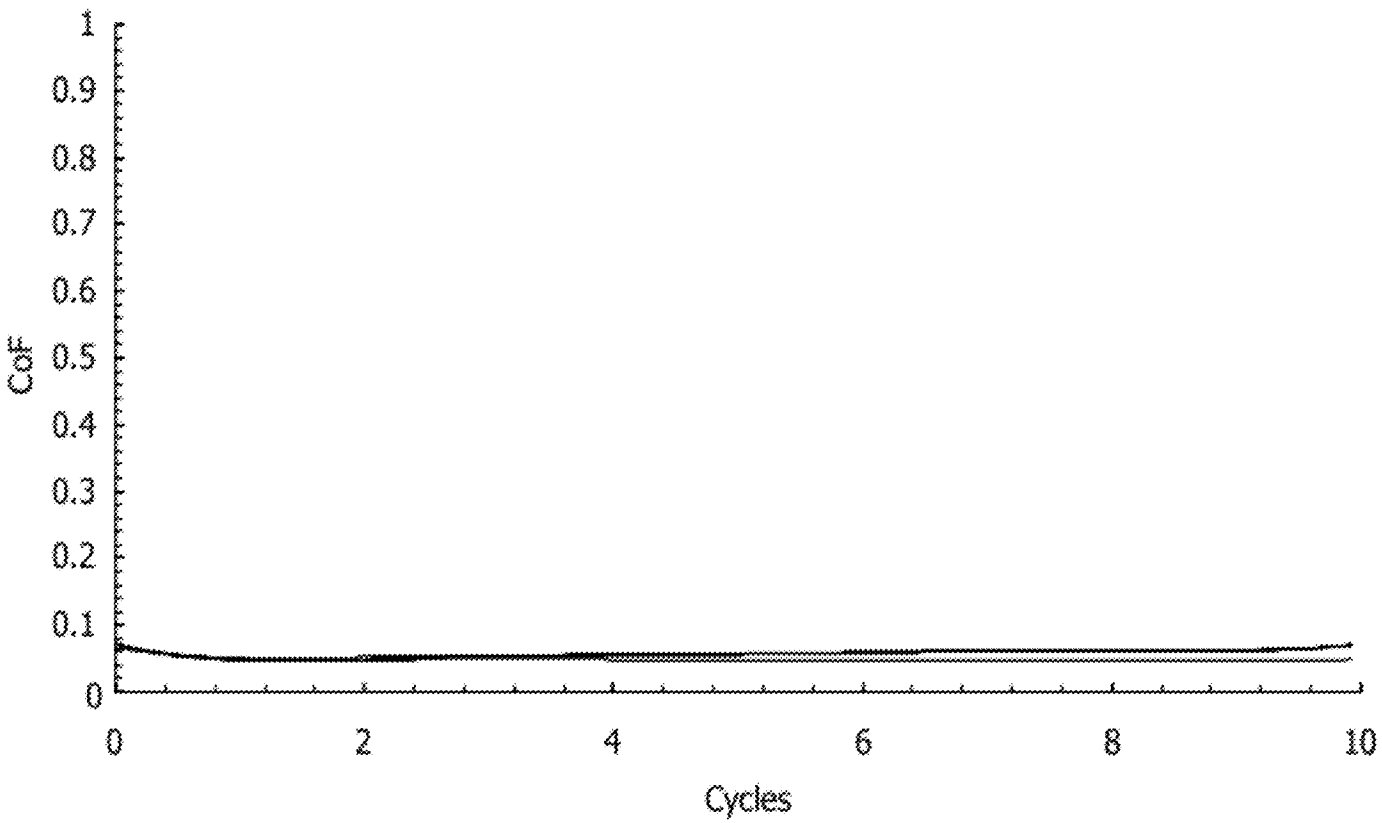
Figure 10C:
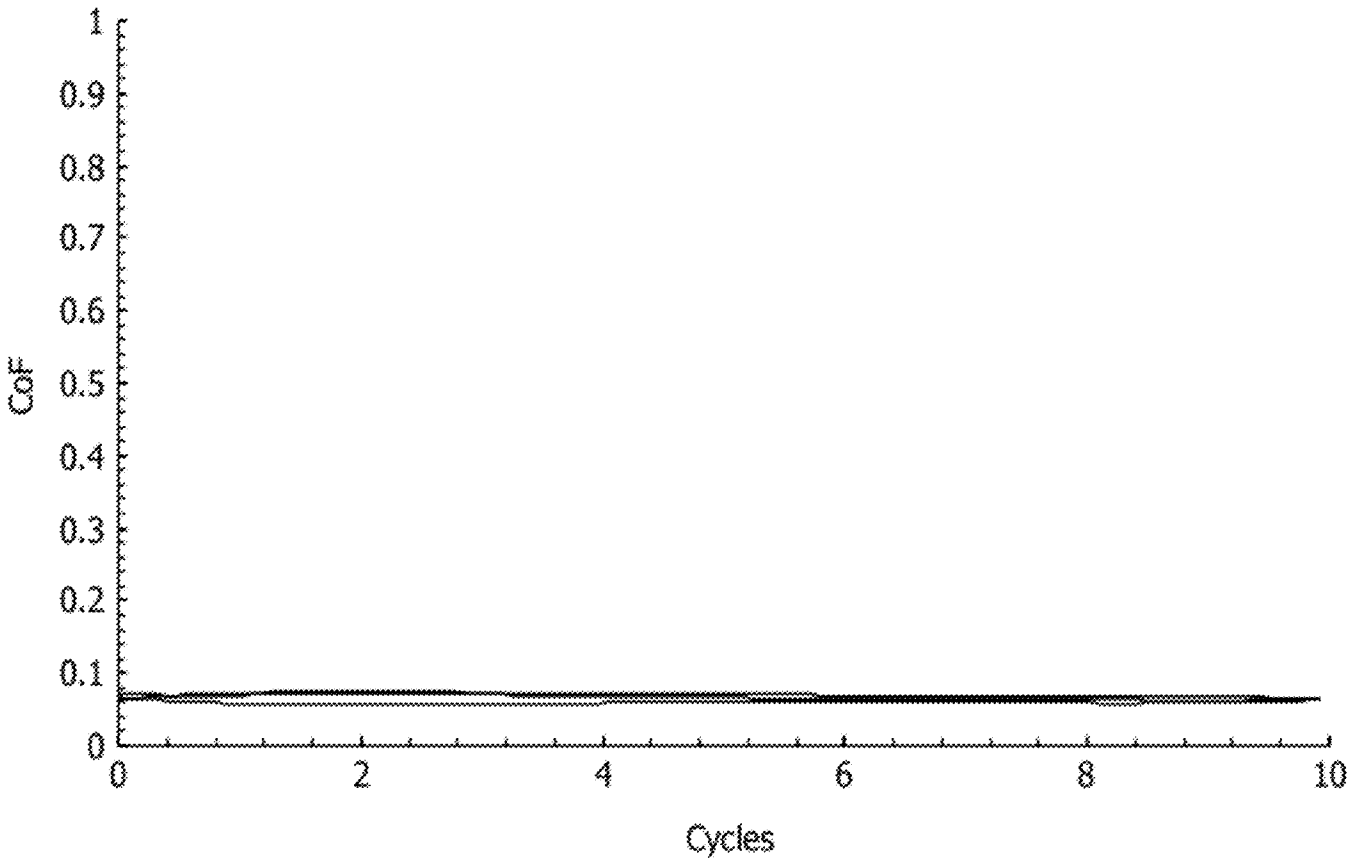

FIG. 10A is a graph constructed from data obtained from the coefficient of friction test of a pure, bright tin layer. The coefficient of friction varied from 0.36 to 0.82. FIG. 10B is a graph constructed from data obtained from the coefficient of friction test of a bright tin-based composite coating obtained using the electrolytic composition of Example 1. The coefficient of friction for the composite varied from 0.04 to 0.08, which indicates its lubricity compared to the pure tin layer and its increased resistance to wear. FIG. 10C is a graph constructed from data obtained from the coefficient of friction test of a bright tin-based composite coating obtained using the electrolytic composition of Example 2. The coefficient of friction for the composite varied from 0.06 to 0.08, which indicates its lubricity compared to the pure tin layer and its increased resistance to wear.

Example 9

Measurement of Interfacial Contact Angle of a Pure, Bright Tin Layer and of a Bright, Tin-Based Composite Coating Comprising Tin and Fluoropolymer Particle The contact angles of the deposits plated according to the method of Example 4 were measured using a Tantec Contact Angle Meter (measures contact angle by Sessile Drop Method). Contact angle was measured three times for a pure tin layer deposited from the electrolytic composition of Example 3 (Sample A), a composite coating deposited from the electrolytic composition of Example 1 (Sample B), and a composite coating deposited from the electrolytic composition of Example 2 (Sample C). The following Table shows the results:

| | Contact Angle | | |
|---|---|---|---|
| Sample | Test #1 | Test #2 | Test #3 |
| A | 28 | 32 | 32 |
| B | 58 | 50 | 48 |
| C | 84 | 86 | 86 |

The increased contact angles observed for Samples B and C reflect the composite coatings' increased hydrophobicity. Since water does not wet the composite coatings as well as a pure tin coating, the contact angle test may be interpreted as an indirect measure of the increased corrosion resistance of the composite coatings compared to a pure tin deposit.

Example 10

Measurement of Corrosion Resistance of a Pure Tin Layer and a Composite Coating Comprising Tin and Fluoropolymer Particle The bright, tin-based composite coatings plated from the compositions of Examples 1 and 2 were measured for corrosion resistance by exposing them to an ambient humidity of 85% relative humidity at 85° C. The samples were exposed for 24 hours in this ambient environment and observed for discoloration at 8 hours and at 24 hours. No discoloration was observed for the tin composite coating comprising fluoropolymer particles, indicating excellent corrosion resistance to a high heat, high humidity environment.

Example 11

Figure 11A:
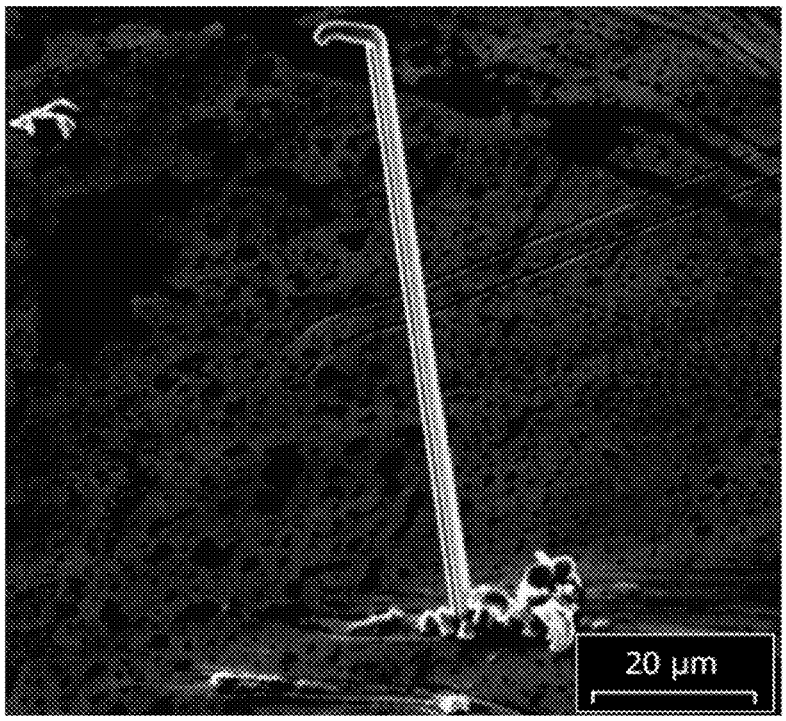
FIGS. 11A through 11C are SEM images of aged tin deposits.
Figure 11B:
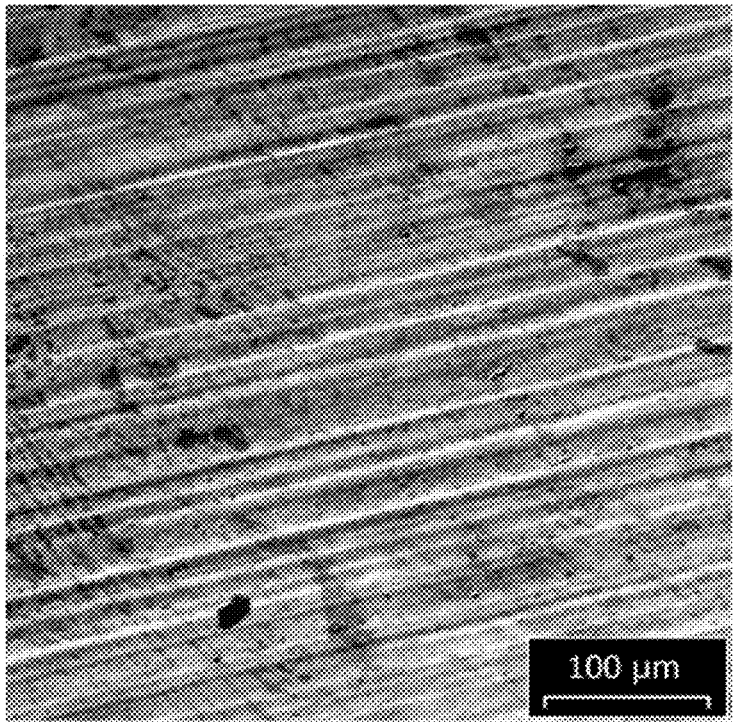
Figure 11C:
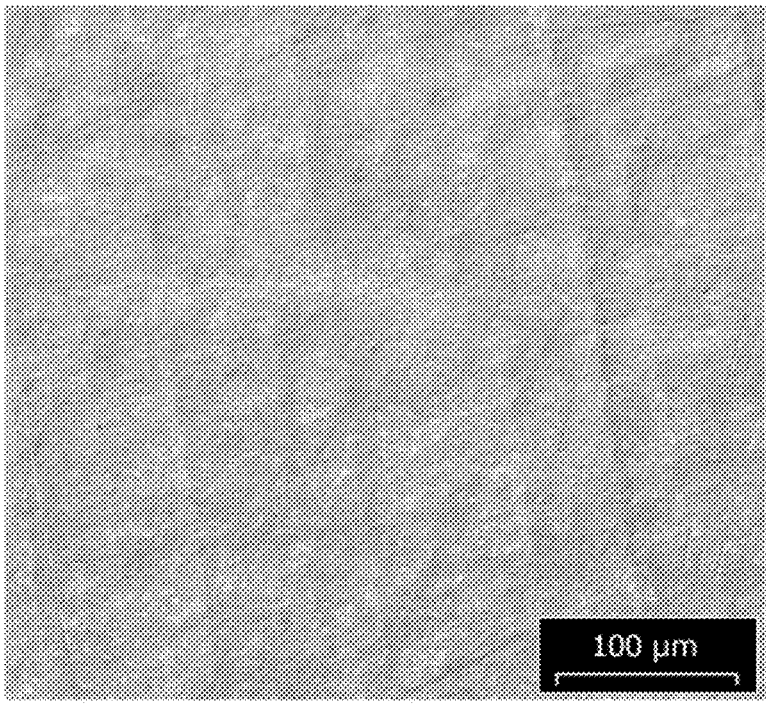

Measurement of Tin Whisker Resistance of a Pure Tin Layer and of a Composite Coating Comprising Tin and Fluoropolymer Particle A bright pure tin layer and two bright composite coatings were aged for 2 months at room temperature in a non-controlled ambient and then inspected for the growth of tin whiskers. FIG. 11A is an SEM image (scale=20 μm) of the bright, pure tin layer. A prominent tin whisker is readily apparent. FIG. 11B (composite deposited from electrolytic composition of Example 1) and FIG. 11C (composite deposited from electrolytic composition of Example 1) are SEM images (scale=100 μm) of the composite coatings. Although less magnified compared to FIG. 11A, no tin whiskers are apparent in the images of FIGS. 11B and 11C.

Example 12

Figure 12A:
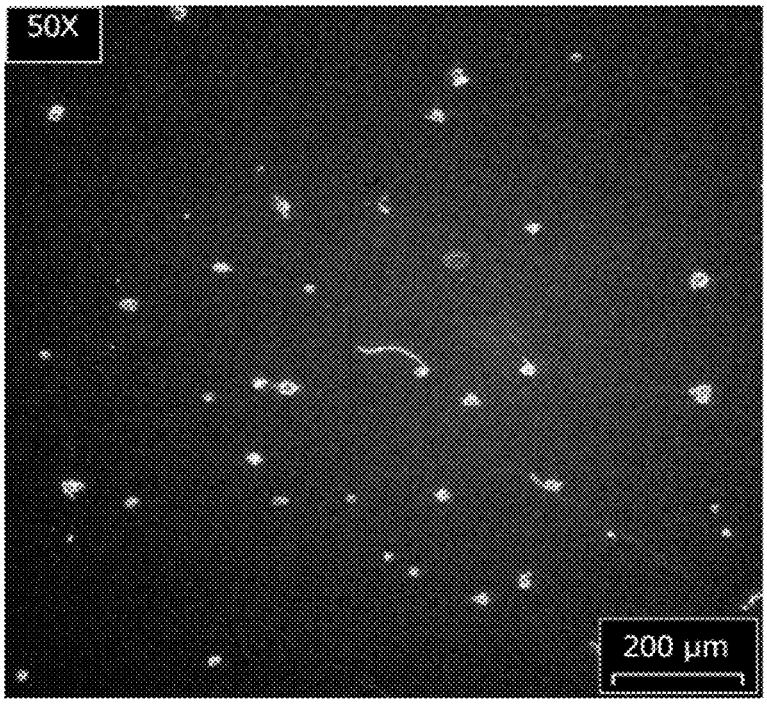
FIGS. 12A and 12B are SEM images of an aged pure tin deposit.
Figure 12B:
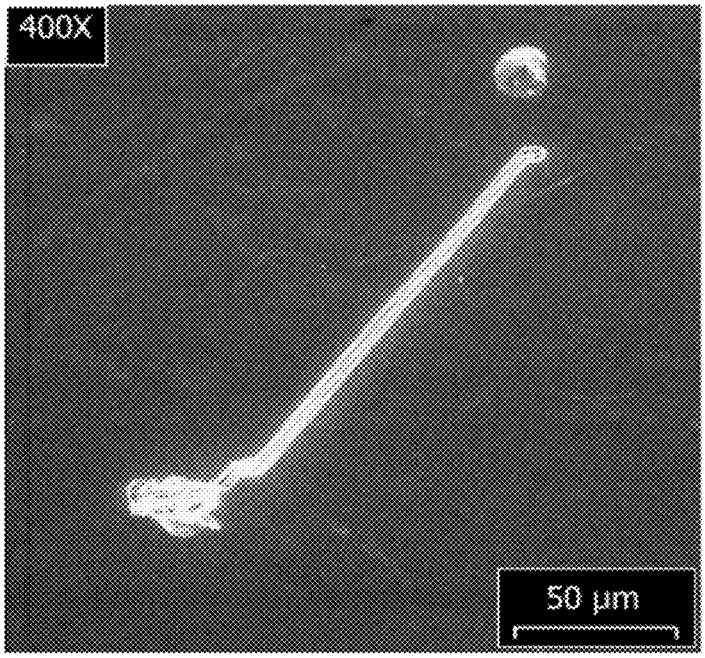

Measurement of Tin Whisker Resistance of a Pure Tin Layer and of a Composite Coating Comprising Tin and Fluoropolymer Particle A bright pure tin layer and two bright composite coatings were aged for 70 days at 50° C. and then for 107 days at room temperature in a non-controlled ambient and then inspected for the growth of tin whiskers. FIG. 12A is an SEM image (50× magnification, scale=200 μm) of the bright, pure tin layer. Defects, i.e., tin whiskers are readily apparent. FIG. 12B is an SEM image at greater magnification (400× magnification, scale=50 μm) of the bright, pure tin layer. The image focuses on a prominent tin whisker.

Figure 13A:
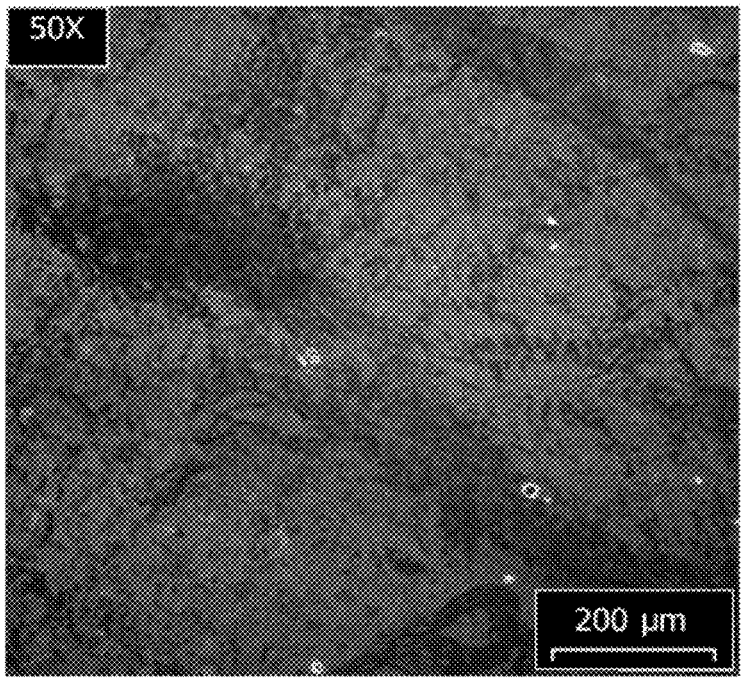
FIGS. 13A and 13B are SEM images of an aged composite coating of the invention.
Figure 13B:
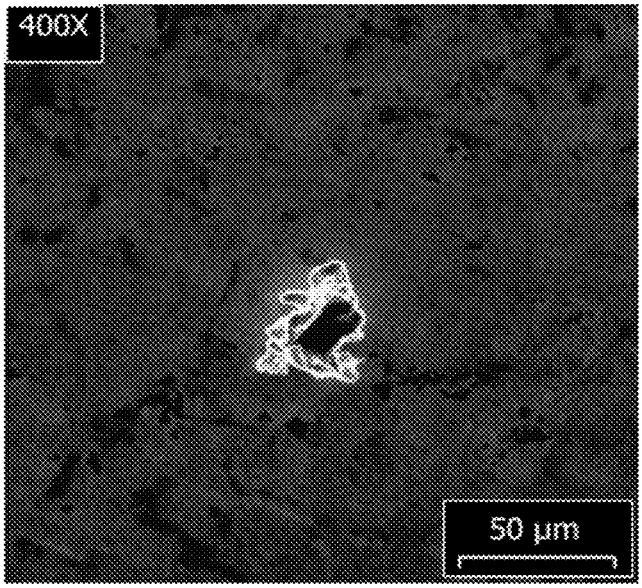

FIG. 13A is an SEM image (50× magnification, scale=200 μm) of a composite coating deposited from the electrolytic composition of Example 1. Far fewer defects (compared to those seen in FIG. 12A), i.e., tin whiskers, are observed at this magnification. FIG. 13B is an SEM image at greater magnification (400× magnification, scale=50 μm) of the composite coating. The image focuses on a defect, but it is readily apparent that the defect does not have a whisker.

Figure 14A:
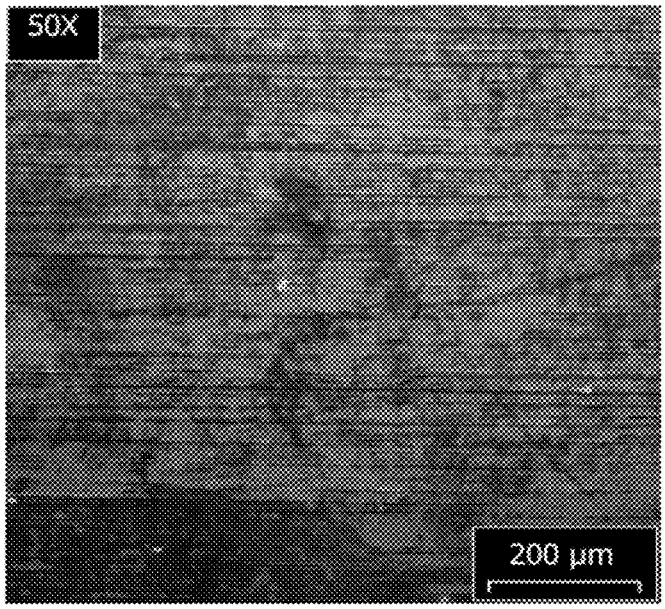
FIGS. 14A and 14B are SEM images of an aged composite coating of the invention.
Figure 14B:
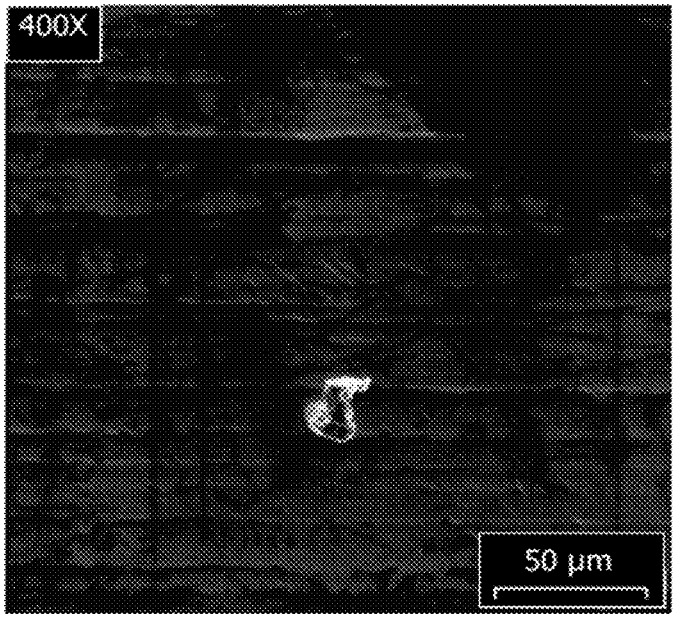

FIG. 14A is an SEM image (50× magnification, scale=200 μm) of a composite coating deposited from the electrolytic composition of Example 2. Very few defects, i.e., tin whiskers, are observed at this magnification. FIG. 14B is an SEM image at greater magnification (400× magnification, scale=50 μm) of the composite coating. The image focuses on a defect that is noticeably smaller than that shown in FIG. 13B. Again, this defect has not developed a whisker.

Example 13

Stress Measure Tests

Figure 15:
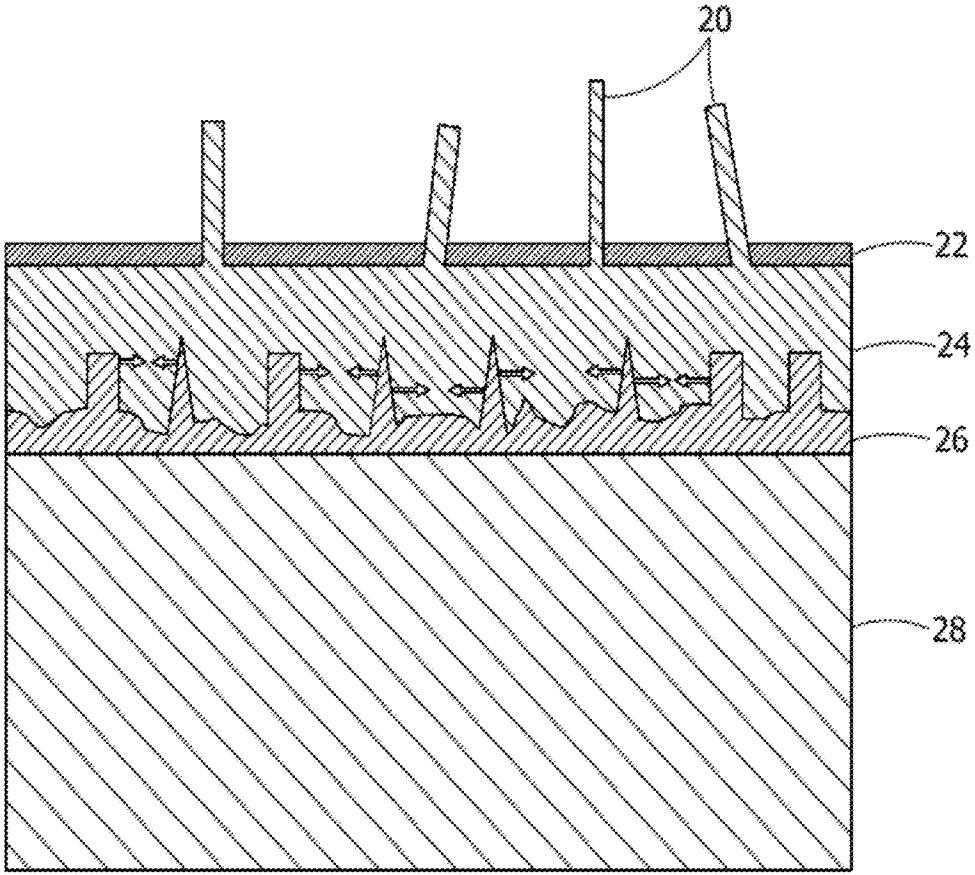
FIG. 15 is a depiction of the compressive stress mechanism which causes tin whiskers to form on tin coatings over base metals.

FIG. 15 is a depiction of tin whisker growth 20 in a substrate comprising a copper base substrate 28 over which is deposited a pure tin layer 24. Tin whisker growth 20 is thought to be due to compressive stress in a $CuSn_x$ intermetallic layer 26 that forms between the copper base 28 and tin overlayer 24. Compressive stress is thought to occur in tin when tin is directly applied to a common base material, such as copper and its alloys, because tin atoms diffuse into the base material more slowly than the base material's atoms diffuse into the tin coating. This behavior eventually forms a $CuSn_x$ intermetallic layer 26. The compressive stress, indicated in FIG. 15 by the arrows, in the tin layer promotes the growth of tin whiskers 20 through the tin oxide layer 22.

Figure 16:
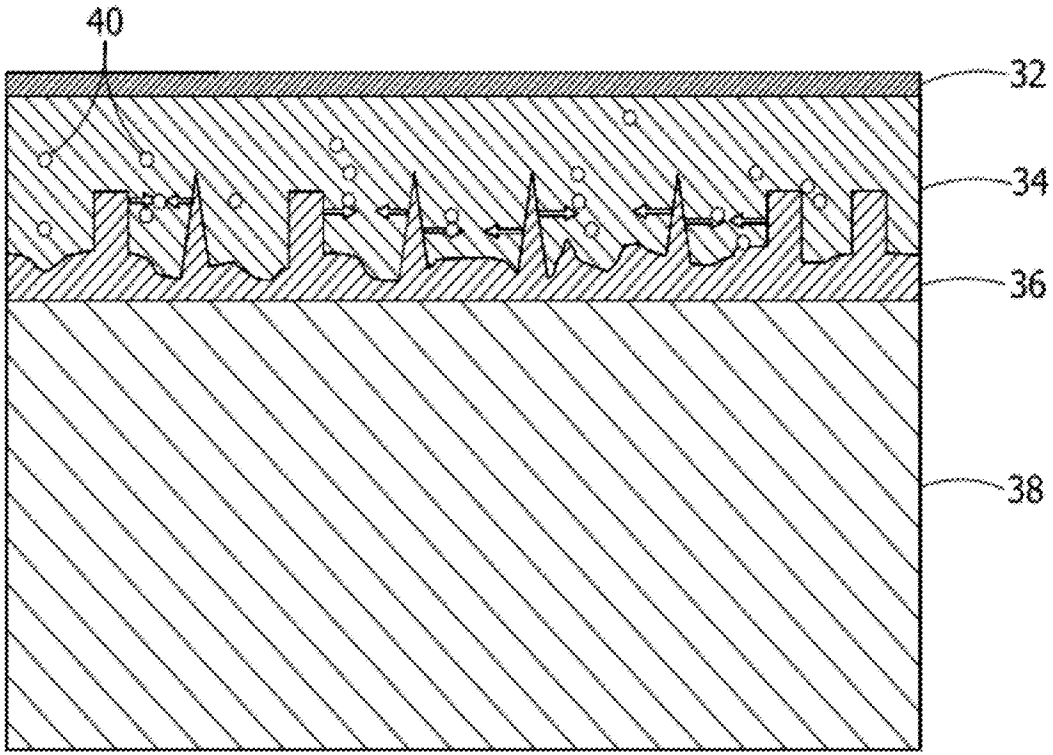
FIG. 16 is a depiction of the mechanism by which fluoropolymer particles relieve compressive stress and inhibit tin whisker formation.

Without being bound to a particular theory, it is thought that incorporated fluoropolymer particles 40, as shown in FIG. 16, such as Teflon®, in the tin layer 34 are a soft material in the tin-coating, which serves as a stress buffer, as shown in FIG. 16, to relieve compressive stress caused by the diffusion of copper atoms from the copper substrate 38 into the tin coating 34 forming the $CuSn_x$ intermetallic layer 36 and thus reduce the occurrence of tin whiskers. The compressive stress relief provided by fluoropolymer particles is depicted in FIG. 16 by the arrows pointing toward incorporated particles, thereby relieving stress and inhibiting the formation of tin whiskers in the tin oxide layer 32.

Figure 17:
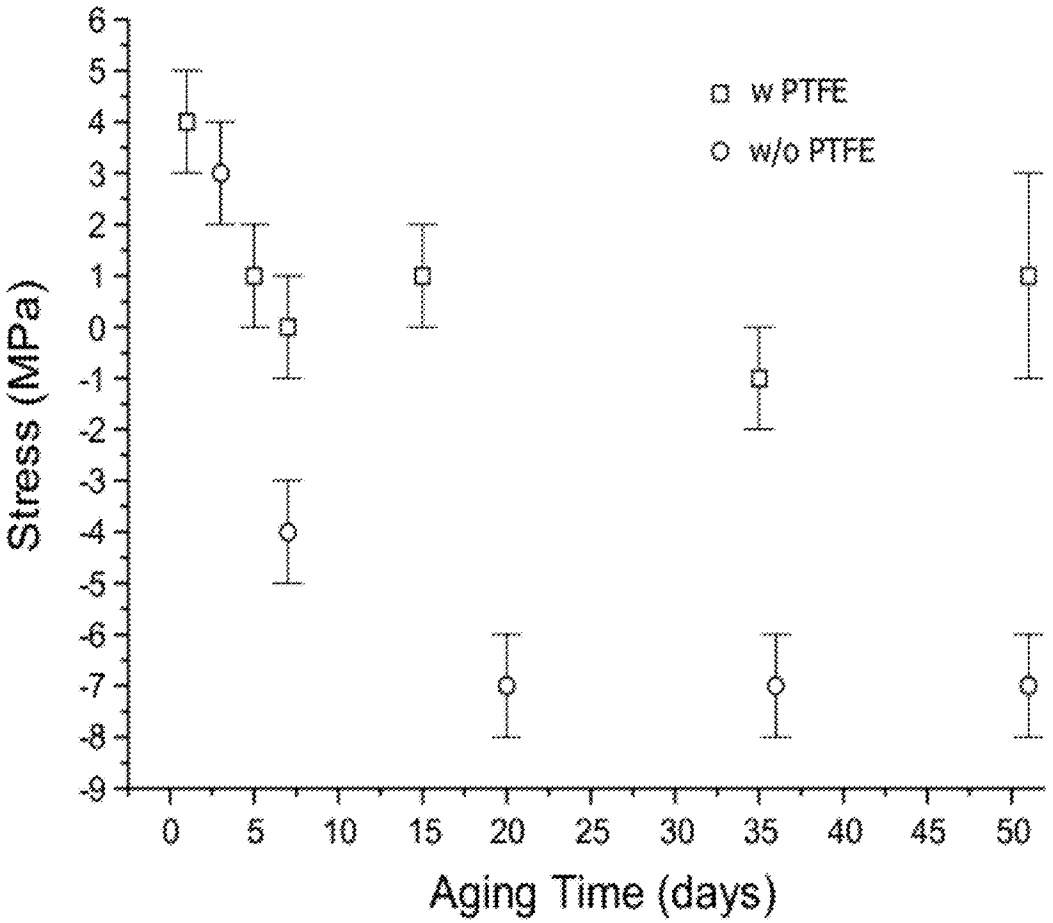
FIG. 17 is a graph of stress measurements for aged pure tin layers and aged composite coatings of the invention.

The theory that fluoropolymer particles may reduce compressive stress was tested empirically. FIG. 17 is a graph showing stress measurements as measured by X-ray diffraction (XRD) of a pure tin layer and a composite coating comprising tin and fluoropolymer particles. It is apparent from the graph that compressive stress decreases over time in the pure tin layer, while the compressive stress of the composite coating remains relatively constant.

Example 14

Dispersion Tests

A test was performed to demonstrate differences between an electrolytic tin composition employing PTFE particles provided in a pre-coated dispersion to an electrolytic tin composition employing PTFE particles provided in uncoated form. For a comparative sample A where no PTFE particles are present, the composition of comparative Example 3 was used. For samples B and C of electrolytic tin compositions where the PTFE particles are provided in a pre-coated dispersion, compositions prepared according to above Examples 1 and 2 were used. For a composition D where the PTFE particles are provided in uncoated form, a composition was prepared comprising the following components:

100-145 g/L $Sn(CH_3SO_3)_2$ (40 to 55 g/L $Sn^{2+}$ ions)

150-225 mL/L $CH_3SO_3H$ (70% methane sulfonic acid solution in water)

16 g dry PTFE powder (Teflon® TE-5069AN)

80-120 mL/L Stannostar® 1405 Additives

Figure 18A:
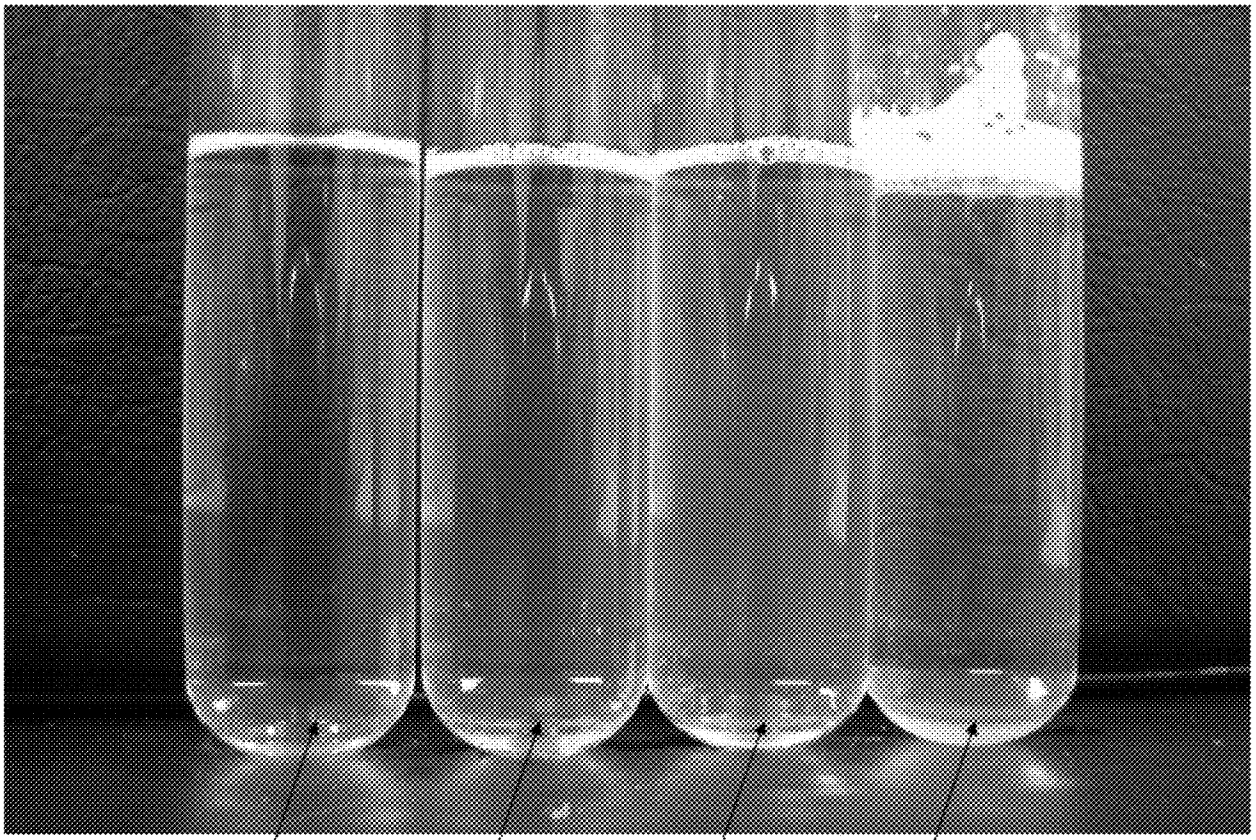
FIGS. 18A and 18B are photographs of electrolytic plating compositions.
Figure 18B:
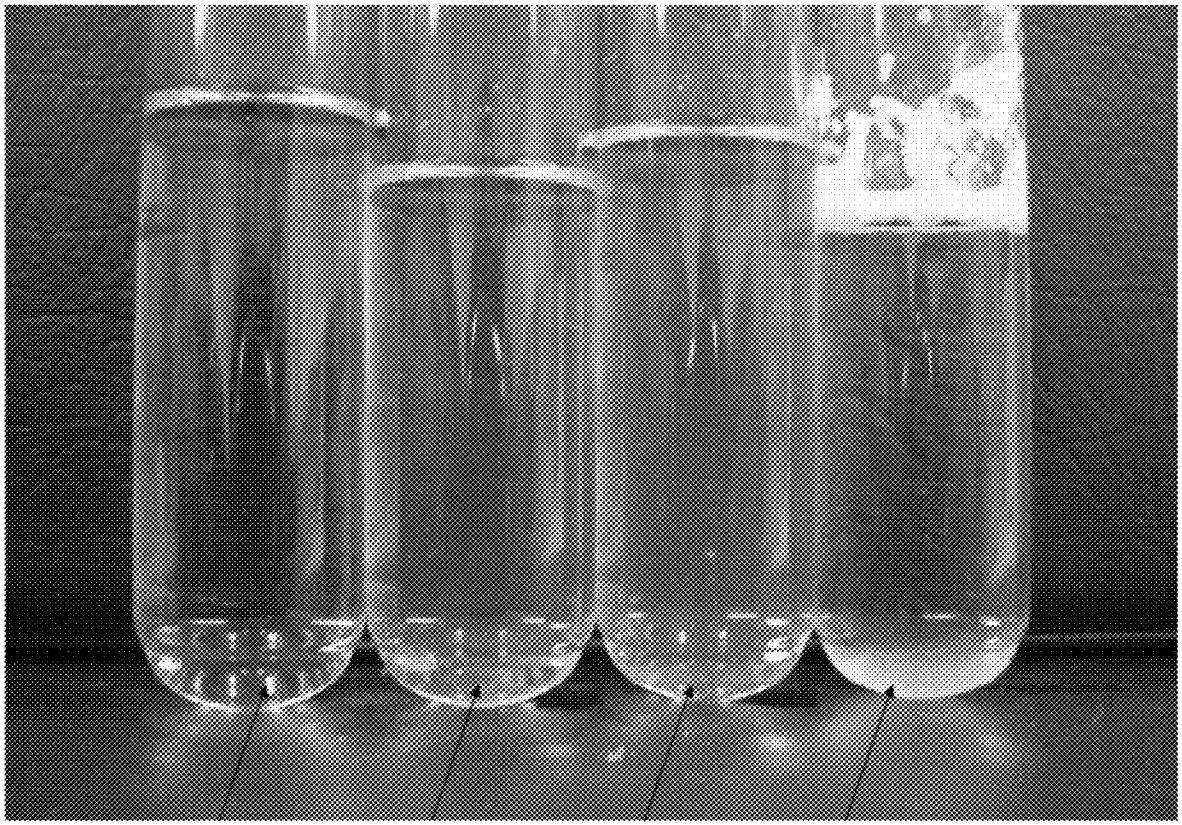

The pH of the composition was about 0. The solution was vigorously stirred in an attempt to disperse the dry PTFE powder. The foregoing samples A, B, C, and D were placed in test tubes. A photograph of the freshly made solutions is shown in FIG. 18A, and of the solutions after 3 days aging is shown in FIG. 18B. These demonstrate that in both FIGS. 18A and 18B, the uncoated particles (sample D) did not disperse well in comparison to the particles of the pre-coated dispersion. These photographs also show that the compositions with the pre-coated particles are very similar in appearance to the composition with no PTFE particles, even after three days, demonstrating uniform dispersion of the nanoparticles and good shelf life.

Figure 19A:
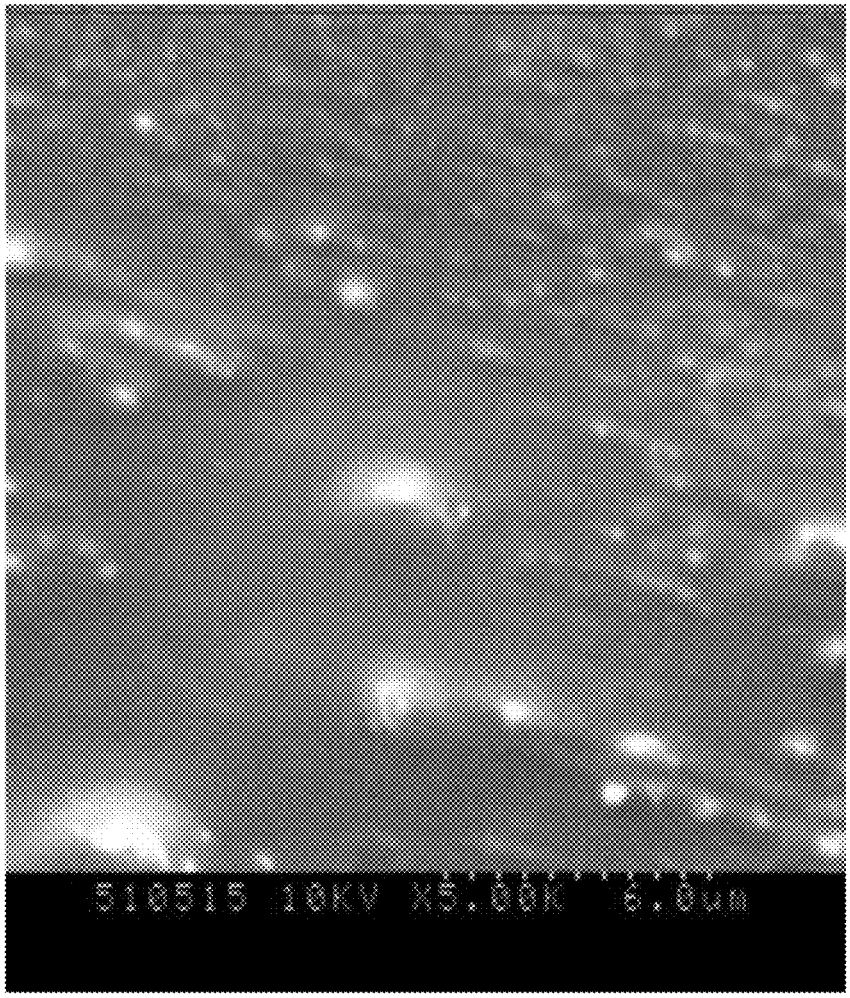
FIGS. 19A and 19B are SEM images of a tin-based composite coating comprising fluoropolymer particles deposited according to the method of Example 14.
Figure 19B:
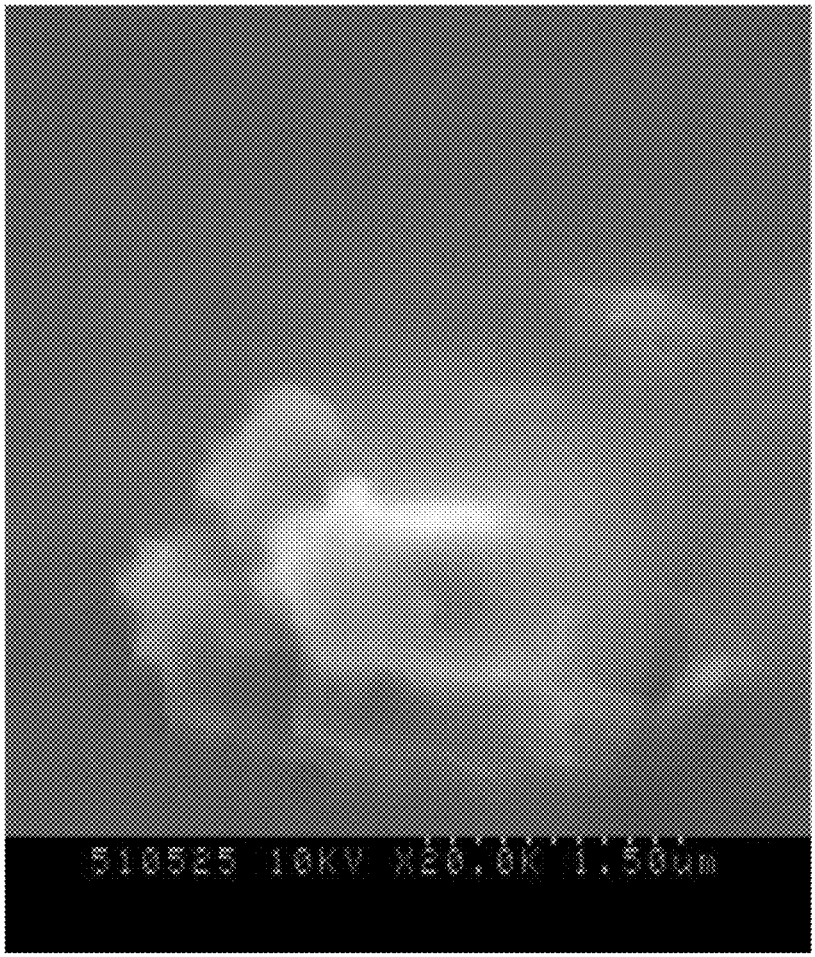

A composite coating was deposited using the composition sample D of this Example and the conditions described in Example 4. SEM images of the coating are shown in FIGS. 19A (5000× magnification) and 19B (20,000× magnification) . The SEM images show large particles on the surface of the composite coating, indicative of deposition of large, agglomerated PTFE particles. This is in contrast to the deposits shown in FIGS. 2 and 3, which show relative uniform composite coatings.

Example 15

Electrolytic Plating Composition for Depositing a Composite Coating Comprising Tin and Fluoropolymer Particles Several compositions for electrolytically plating a matte, tin-based composite coating comprising fluoropolymer nanoparticles was prepared comprising the following components:

155 to 265 g/L $Sn(CH_3SO_3)_2$ (60 to 100 g/L $Sn^{2+}$ ions)

70 to 180 mL/L $CH_3SO_3H$ (70% methane sulfonic acid solution in water)

5, 10, 20, and 30 mL/L PTFE dispersion 1 to 4 g/L hydroquinone 5 to 10 g/L Lugalvan BNO 12

50 to 120 ppm Dodigen 226

5 to 20 ppm Fluowet PL 80

The pH of the composition was about 0. One liter of this composition was prepared.

Example 16

Measurement of Fluorine Content in and Wetting Angle of Composite Coatings

Four composite coatings comprising tin fluoropolymer nanoparticles (using the electrolytic plating compositions of Example 15) were plated onto copper foils. The coatings were deposited using the composition of Example 15, wherein the concentration of the PTFE dispersion was 5 mL/L, 10 mL/L, 20 mL/L, and 30 mL/L. The samples were plated in a beaker, and agitation was provided using a stir bar. To deposit the composite coatings comprising tin and fluoropolymer nanoparticles, the applied current density was 15 ASD, the plating duration was 20 seconds, and the deposit thickness was 2.5 micrometers, for a plating rate of 7.5 micrometers per minute.

Figure 20:
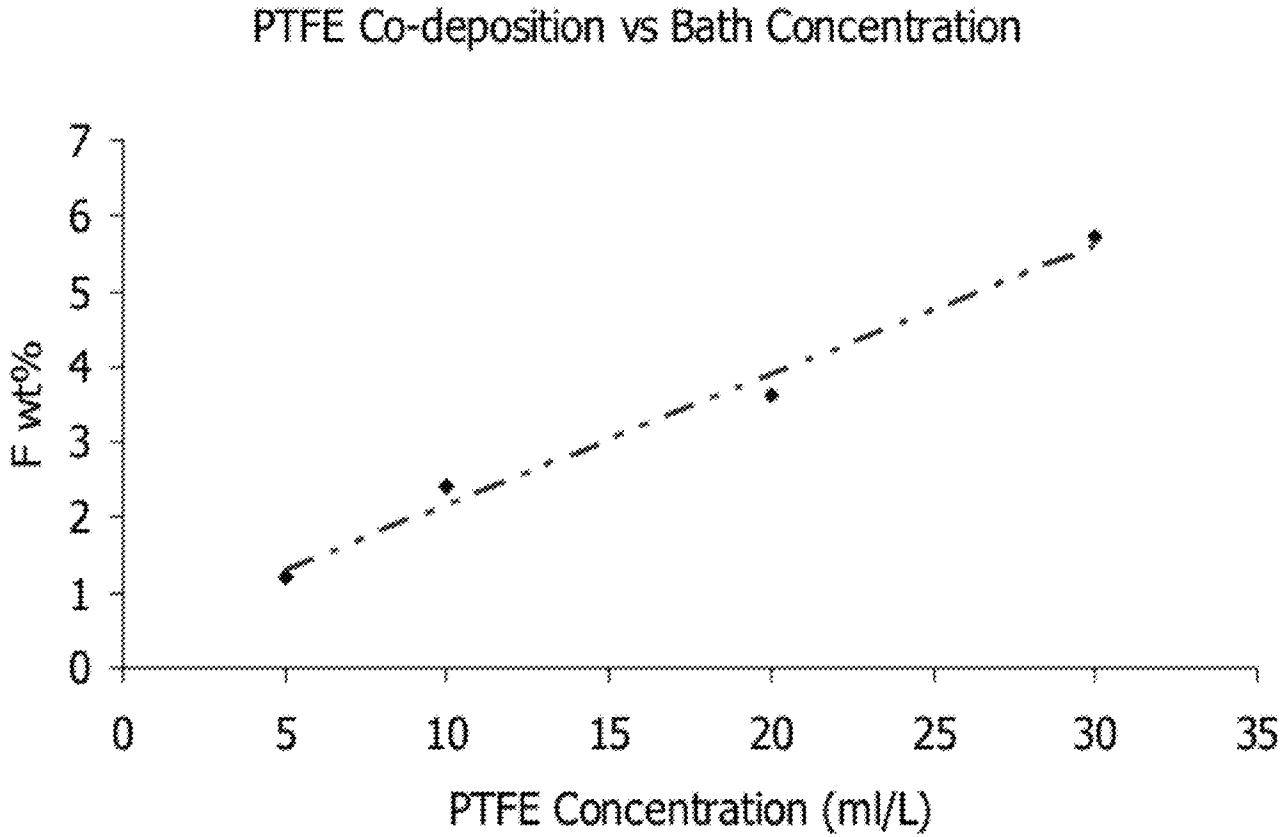
FIG. 20 is a graph showing that the fluorine contents in composite coatings deposited from electrolytic plating compositions increases relatively linearly with the fluorine dispersion concentration in the electrolytic plating compositions. The data were obtained according to the method of Example 16.

The fluorine content of each of the composite coatings was measured using EDS as a function of PTFE dispersion concentration in the deposition solution. FIG. 20 is a graph showing that the increase in fluorine content from the composition of Example 15 was linear through each PTFE dispersion concentration ($R^2$=0.9858).

Figure 21:
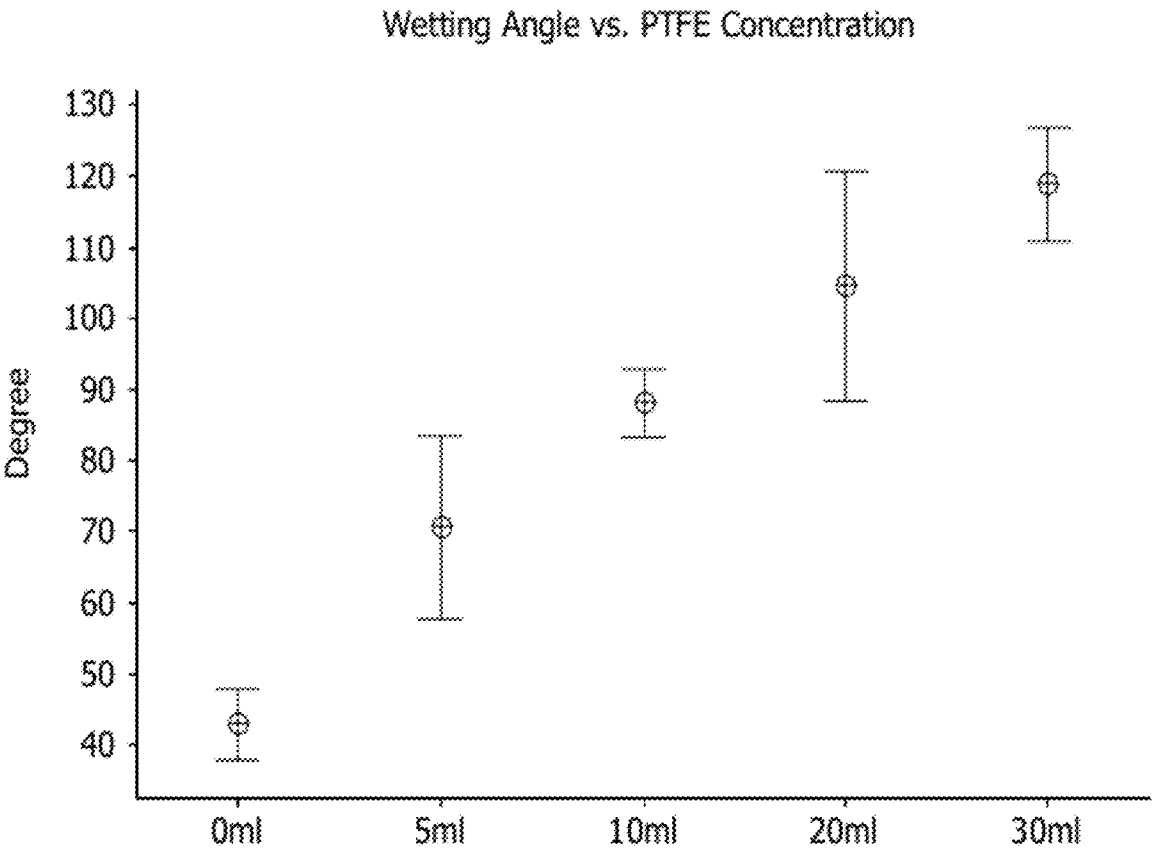
FIG. 21 is a graph showing that the wetting angles of composite coatings deposited from electrolytic plating compositions increases with the fluorine dispersion concentration in the electrolytic plating compositions. The data were obtained according to the method of Example 16.

The wetting angles were also measured for the composite coatings deposited from the electrolytic plating compositions prepared from the compositions of Example 15. FIG. 21 depicts the increase in wetting angle observed in the composite coatings deposited from the compositions of Example 15. The increase in wetting angle is indicative of increasing hydrophobicity, which further indicates higher corrosion resistance and higher lubricity.

Example 17

Lead Free Reflow and Solderability

Figure 22:
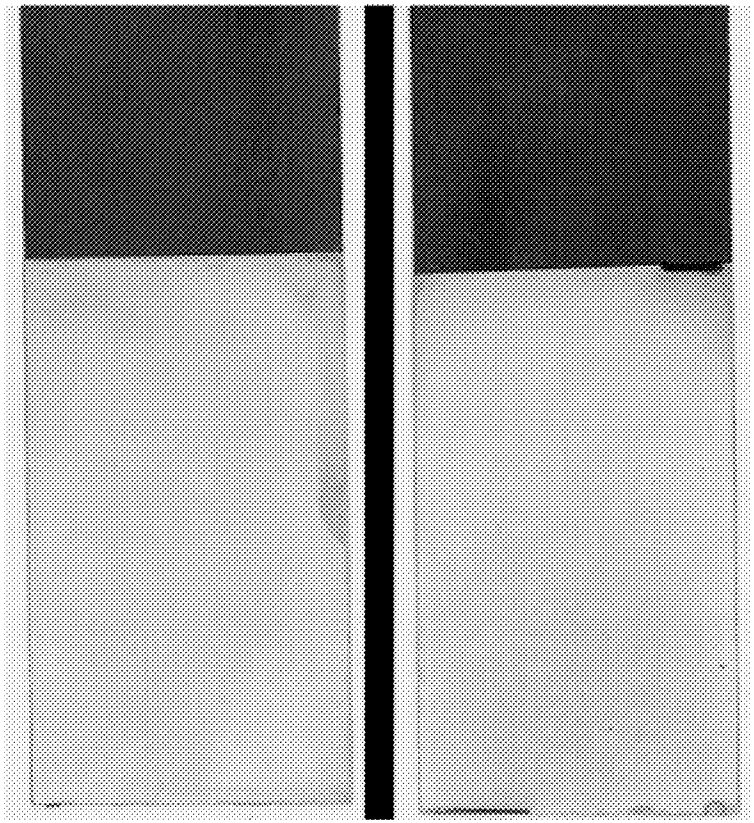
FIG. 22 is an optical photograph of two copper coupons having composite coatings thereon after 1× lead free reflow. The coupons were coated and reflowed according to the method of Example 17.
Figures 23A, 23B, 23C:
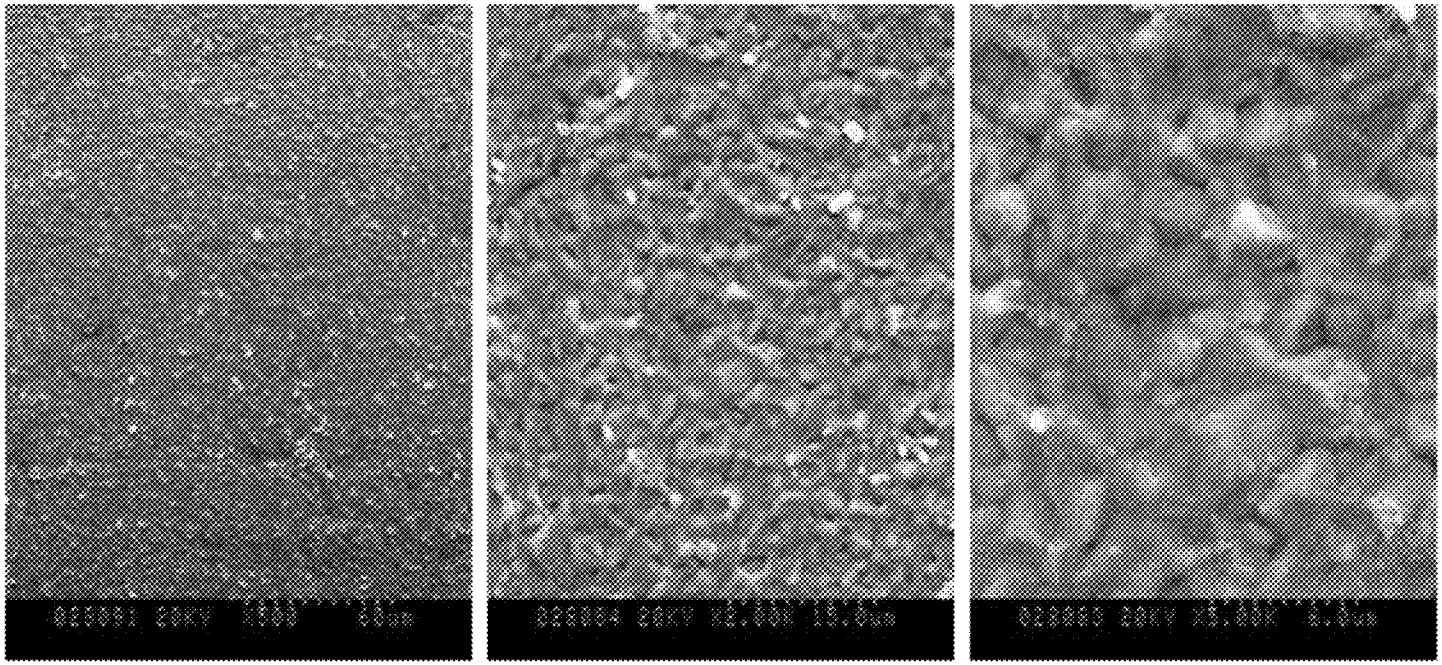
FIGS. 23A, 23B, and 23C (5000× magnification) are SEM images of a copper coupon having a composite coating thereon after 1× lead free reflow. The coupon was coated and reflowed according to the method of Example 17.

Two composite coatings deposited from the Composition of Example 15 having 30 mL/L PTFE dispersion onto copper foils were subjected to a 1× lead free reflow and visually inspected. FIG. 22 is an optical photograph of two of the coupons. No discoloration due to oxidation was observed in either composite coating after a 1× lead free reflow. FIGS. 23A (500× magnification), 23B (2000× magnification), and 23C (5000× magnification) are SEM images of one of the coupons after a 1× lead free reflow. Even at 5000× magnification, there is no oxidation or tin-whisker growth.

Figure 24:
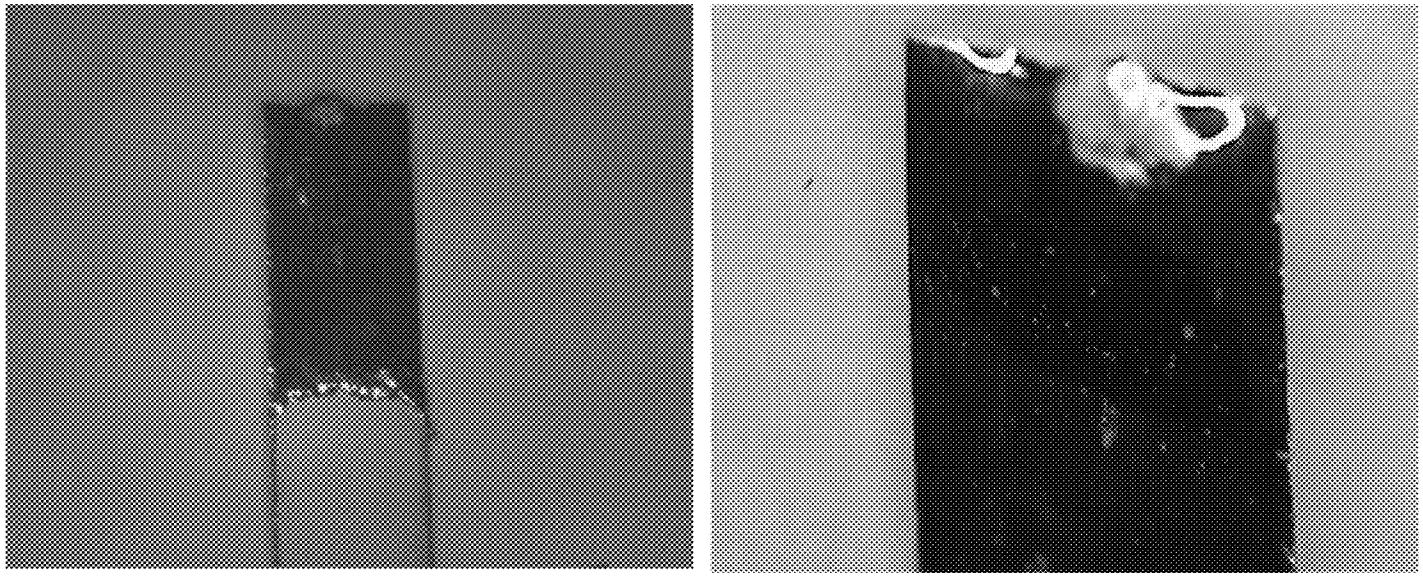
FIG. 24 is a photograph of a copper coupon having a composite coating thereon that was wetted with solder. The composite coating was deposited on the copper coating from a fresh electrolytic plating composition.
Figure 25:
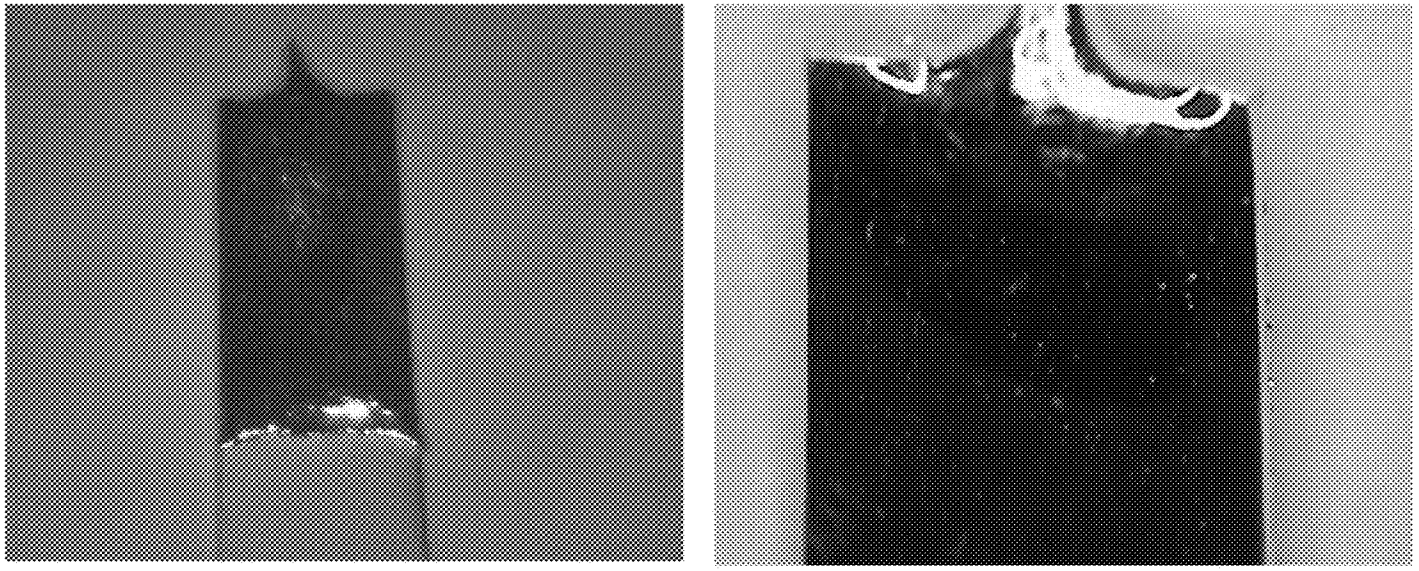
FIG. 25 is a photograph of a copper coupon having a composite coating thereon that was wetted with solder. The composite coating was deposited on the copper coating from a replenished electrolytic plating composition after 1 bath turnover.
Figure 26:
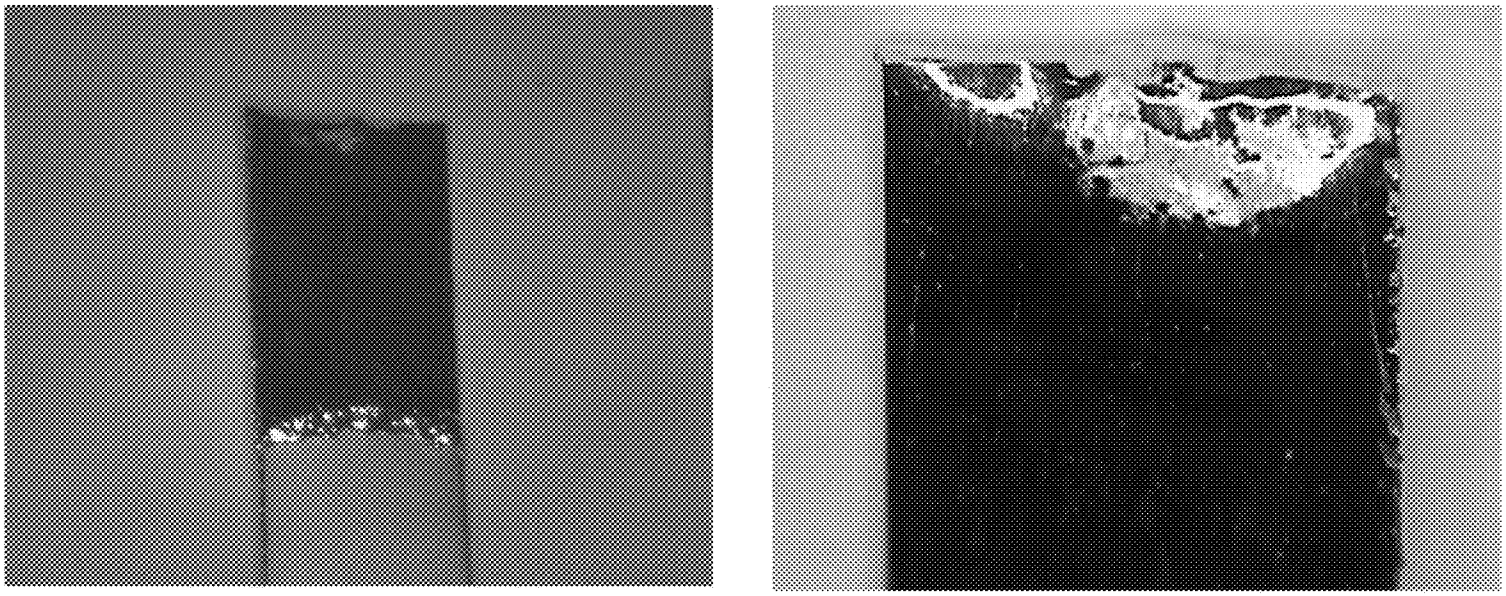
FIG. 26 is a photograph of a copper coupon having a composite coating thereon that was wetted with solder. The composite coating was deposited on the copper coating from a replenished electrolytic plating composition after 2 bath turnovers.

The solderability of composite coatings was qualitatively tested through multiple metal bath turnovers. Three copper coupons having composite coatings thereon, which were wetted by solder are shown in FIGS. 24, 25, and 26. The solder wetted coupon shown in FIG. 24 was coated with a fresh tin-fluoropolymer plating composition of Example 15 having 30 mL/L PTFE dispersion. The solder wetted coupon shown in FIG. 25 was coated with a tin-fluoropolymer plating composition of Example 15 having 30 mL/L PTFE dispersion, wherein the tin and fluoropolymer components were replenished through one bath turnover. The solder wetted coupon shown in FIG. 26 was coated with a tin-fluoropolymer plating composition of Example 15 having 30 mL/L PTFE dispersion, wherein the tin and fluoropolymer components were replenished through two bath turnovers. It can be seen from FIGS. 24, 25, and 26 that the composite coatings of the invention are easily wettable by solder and that the coating solderability is reproducible through multiple bath turnovers.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. For example, that the foregoing description and following claims refer to "an" electrical component means that there are one or more such components. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A method for applying a composite coating onto a metal surface of an electrical component, the method comprising:

contacting the metal surface with an electrolytic plating composition comprising (a) a source of tin ions and (b) a pre-mixed dispersion comprising a cationic surfactant in combination with an anionic surfactant and fluoropolymer particles having a mean particle size between about 40 and about 120 nanometers and at least 30 vol % of the particles have a particle size less than 100 nm, wherein the fluoropolymer particles have a pre-mix coating of surfactant molecules thereon; and applying an external source of electrons to the electrolytic plating composition to thereby electrolytically deposit the composite coating onto the metal surface, wherein the composite coating comprises tin and the fluoropolymer particles.

2. The method of claim 1 wherein at least 25 vol % of the fluoropolymer have a particle size less than 90 nm.

3. The method of claim 1 wherein a current density is applied between about 10 and about 15 A/dm$^2$.

4. The method of claim 1 wherein the composite coating contains 10 wt. % or less of fluoropolymer particles.

5. The method of claim 1 wherein the composite coating contains 5 wt. % or less of fluoropolymer particles.

6. The method of claim 1 wherein the composite coating contains between about 1 wt. % and about 5 wt. % of fluoropolymer particles.

7. A method for applying a composite coating onto a metal surface of an electrical component, the method comprising:

contacting the metal surface with an electrolytic plating composition comprising (a) a source of tin ions and (b) a pre-mixed dispersion comprising a cationic surfactant and fluoropolymer particles having a mean particle size between about 40 and about 120 nanometers and at least 30 vol % of the particles have a particle size less than 100 nm, wherein the fluoropolymer particles have a pre-mix coating of surfactant molecules thereon; and applying an external source of electrons to the electrolytic plating composition to thereby electrolytically deposit the composite coating onto the metal surface, wherein the composite coating comprises tin and the fluoropolymer particles.

8. The method of claim 7 wherein at least 25 vol % of the fluoropolymer particles have a particle size less than 90 nm.

9. The method of claim 7 wherein a current density is applied between about 10 and about 15 A/dm$^2$.

10. The method of claim 7 wherein the composite coating contains 10 wt. % or less of fluoropolymer particles.

11. The method of claim 7 wherein the composite coating contains 5 wt. % or less of fluoropolymer particles.

12. The method of claim 7 wherein the composite coating contains between about 1 wt. % and about 5 wt. % of fluoropolymer particles.

13. A method for applying a composite coating onto a metal surface of an electrical component, the method comprising:

contacting the metal surface with an electrolytic plating composition comprising (a) a source of tin ions and (b) a pre-mixed dispersion comprising fluoropolymer particles having a mean particle size between about 40 and about 120 nanometers and at least 30 vol % of the particles have a particle size less than 100 nm, wherein the fluoropolymer particles have a pre-mix coating of surfactant molecules thereon; and applying an external source of electrons to the electrolytic plating composition to thereby electrolytically deposit the composite coating onto the metal surface, wherein the composite coating comprises tin and the fluoropolymer particles and wherein the pre-mixed dispersion of fluoropolymer particles comprises a quaternary ammonium salt cationic surfactant, fluoroalkyl ammonium cationic surfactant, and a nonionic surfactant.

14. The method of claim 13 wherein at least 25 vol % of the fluoropolymer particles have a particle size less than 90 nm.

15. The method of claim 13 wherein a current density is applied between about 10 and about 15 A/dm$^2$.

16. The method of claim 13 wherein the composite coating contains 10 wt. % or less of fluoropolymer particles.

17. The method of claim 13 wherein the composite coating contains 5 wt. % or less of fluoropolymer particles.

18. The method of claim 13 wherein the composite coating contains between about 1 wt. % and about 5 wt. % of fluoropolymer particles.

* * * * *